US007334683B2

(12) United States Patent
Hassell et al.

(10) Patent No.: US 7,334,683 B2
(45) **Date of Patent: *Feb. 26, 2008**

(54) PORTABLE STORAGE CONTAINER

(75) Inventors: Jon P. Hassell, Atlanta, GA (US); William P. Apps, Alpharetta, GA (US); Matthew L. Dannenfeldt, Libertyville, IL (US)

(73) Assignee: Rehrig Pacific Company, Los Angeles, CA (US)

( * ) Notice: Subject to any disclaimer, the term of this patent is extended or adjusted under 35 U.S.C. 154(b) by 592 days.

This patent is subject to a terminal disclaimer.

(21) Appl. No.: 10/823,243

(22) Filed: Apr. 12, 2004

(65) Prior Publication Data

US 2005/0224385 A1 Oct. 13, 2005

(51) Int. Cl.
*B65D 21/06* (2006.01)
*B65D 85/62* (2006.01)

(52) U.S. Cl. ..... 206/506

(58) Field of Classification Search ..... 206/506, 206/503, 505

See application file for complete search history.

(56) References Cited

U.S. PATENT DOCUMENTS

| | | | |
|---|---|---|---|
| 2,029,746 | A | 2/1936 | Tufts et al. |
| 2,061,414 | A | 11/1936 | Tufts et al. |
| 2,134,875 | A | 11/1938 | Henze |
| 2,609,120 | A | 9/1952 | Williams |
| 3,220,603 | A | 11/1965 | Bromley |
| 3,323,673 | A | 6/1967 | Cowan |
| 3,940,018 | A | 2/1976 | Schoeller |
| 3,951,265 | A | 4/1976 | Carroll |
| 4,106,623 | A | 8/1978 | Carroll |
| 4,109,791 | A | 8/1978 | Clipson et al. |
| 4,241,831 | A | 12/1980 | Locatelli |
| 4,247,004 | A | 1/1981 | Bird |
| 4,391,369 | A | 7/1983 | Stahl |
| 4,423,813 | A | 1/1984 | Kreeger et al. |
| 4,466,541 | A | 8/1984 | Tabler et al. |
| 4,573,577 | A | 3/1986 | Miller |
| RE32,223 | E | 8/1986 | Kreeger et al. |

(Continued)

FOREIGN PATENT DOCUMENTS

| | | |
|---|---|---|
| DE | 35 11 321 | 10/1986 |

(Continued)

OTHER PUBLICATIONS

International Search Report, Oct. 31, 2005.

(Continued)

*Primary Examiner*—Anthony D Stashick
*Assistant Examiner*—Harry A Grosso

(57) ABSTRACT

A portable storage container that both stacks and nests with similar containers includes a plurality of walls extending upwardly from a floor. At least one of the walls includes an inner wall portion and an outer wall portion. At least one of the inner and outer wall portions has an elongated pin opening. A pair of bail members are each movable among a nest position, an upper stack position, a middle stack position and a lower stack position. Each bail member includes a support portion and arm extending transversely from outer ends of the support portion. A pin extends transversely from an outer end of each arm. Each pin is received in one of the pin openings, with the arm received between the inner and outer wall portions.

32 Claims, 26 Drawing Sheets

U.S. PATENT DOCUMENTS

| | | | |
|---|---|---|---|
| 4,643,310 | A | 2/1987 | Deaton et al. |
| 4,759,451 | A | 7/1988 | Apps |
| 4,770,300 | A | 9/1988 | Klein |
| 4,848,578 | A | 7/1989 | Schafer |
| 4,905,833 | A | 3/1990 | Kreeger et al. |
| 4,947,992 | A | 8/1990 | Schafer |
| 4,982,844 | A | 1/1991 | Madan et al. |
| 5,083,666 | A | 1/1992 | Lam |
| 5,415,293 | A | 5/1995 | Ackermann |
| 5,469,986 | A | 11/1995 | Jang |
| 5,494,163 | A | 2/1996 | Apps |
| 5,609,254 | A | 3/1997 | Loftus et al. |
| 5,617,953 | A | 4/1997 | Cope |
| D381,203 | S | 7/1997 | Ackermann |
| D382,404 | S | 8/1997 | Cope |
| 5,752,602 | A | 5/1998 | Ackermann |
| 5,772,033 | A | 6/1998 | Loftus et al. |
| 5,881,902 | A | 3/1999 | Ackermann |
| 5,924,572 | A | 7/1999 | Cope |
| 6,059,114 | A | 5/2000 | Loftus |
| D436,729 | S | 1/2001 | Aiken |
| 6,938,772 | B2 | 9/2005 | Aiken et al. |
| 7,014,043 | B2 | 3/2006 | Raghunathan et al. |
| 7,017,745 | B2 | 3/2006 | Raghunathan |
| 2002/0117420 | A1 | 8/2002 | McDade |
| 2002/0179480 | A1 | 12/2002 | Raghunathan et al. |
| 2003/0230510 | A1 | 12/2003 | Aiken et al. |
| 2005/0263423 | A1 | 12/2005 | Hassell et al. |
| 2005/0263424 | A1 | 12/2005 | Hassell et al. |
| 2006/0108372 | A1 | 5/2006 | Aiken et al. |
| 2006/0231449 | A1 | 10/2006 | Hassell et al. |

FOREIGN PATENT DOCUMENTS

| | | | |
|---|---|---|---|
| DE | 35 21 894 | | 1/1987 |
| DE | 199 39 019 | A1 | 2/2001 |
| DE | 200 02 537 | U1 | 7/2001 |
| EP | 0 311 174 | A1 | 4/1989 |
| EP | 0 368 713 | | 5/1990 |
| EP | 0 557 002 | A | 8/1993 |
| EP | 0 697 341 | A | 2/1996 |
| EP | 0 953 509 | A1 | 3/1999 |
| EP | 0 926 073 | A | 6/1999 |
| EP | 1170223 | | 1/2002 |
| EP | 1241105 | | 9/2002 |
| FR | 2 678 585 | | 1/1993 |
| GB | 2 124 588 | A | 2/1984 |
| GB | 2 129 401 | | 5/1984 |
| GB | 2 137 167 | | 10/1984 |
| GB | 2 141 778 | | 1/1985 |
| GB | 2 171 980 | | 9/1986 |
| GB | 2 180 821 | | 4/1987 |
| GB | 2 209 737 | | 5/1989 |
| GB | 2296009 | | 6/1996 |
| GB | 2333285 | | 7/1999 |
| GB | 2340485 | | 2/2000 |
| GB | 2350350 | | 11/2000 |
| GB | 2373239 | | 9/2002 |
| GB | 2373240 | | 9/2002 |
| GB | 2 374 859 | A | 10/2002 |
| GB | 2425302 | | 10/2006 |
| GB | 2427606 | | 1/2007 |
| NL | 790 5105 | | 6/1979 |
| RU | 171783 | | 3/1966 |
| TW | R.O.C. 338405 | | 8/1998 |
| TW | R.O.C. 372539 | | 10/1999 |
| WO | WO 98/01352 | | 1/1998 |
| WO | WO/0027716 | | 5/2000 |
| WO | WO 00/51900 | | 9/2000 |
| WO | WO 00/66440 | | 11/2000 |
| WO | 2005100179 | | 10/2005 |
| WO | 2005115854 | | 12/2005 |
| WO | 2006036868 | | 4/2006 |

OTHER PUBLICATIONS

International Search Report, Aug. 24, 2005.
International Search Report, Feb. 13, 2006.
United Kingdom Search Report, Jun. 27, 2006.

PORTABLE STORAGE CONTAINER

BACKGROUND OF THE INVENTION

Portable storage containers that both stack and nest with similar containers are commonly used in industry for transporting and storing goods. Nesting is typically achieved when an empty container receives a like container therein such that there is some overlap between the walls and the containers. On the other hand, the stacking feature is typically used when an occupied container has a like container supported thereon, such that there is relatively little or no overlap between the walls of the containers, and the goods contained in the lower container are preferably not contacted or damaged by the upper container. Many containers use members known bail members to achieve the stacking feature. Bail members may typically be positioned out of the way for purposes of nesting, but then moved to a stacking position for allowing containers to be stacked thereon. Often, the stacks may consist of multiple containers having a load. Unfortunately, some containers may not have sufficient strength to accommodate such loads in a stack.

The bail members in some containers are movable among three positions: a nesting position, a first stack position and a second stack position. The bail members support containers in the first stack position at a first distance from the floor, or at the second stack position at a second distance from the floor.

SUMMARY OF THE INVENTION

A container according to one embodiment of the present invention provides a nest position and three selectable heights for the support portions of the bail members. The bail members can be adjusted to support similar containers stacked thereon according to how much is in the container. Additionally, the container provides improved strength and reliability of the bail members, and prevents accidental dislodgement of the bail members from their selected positions.

The container includes a plurality of walls extending upwardly from a floor. At least one of the walls includes an inner wall portion and an outer wall portion. At least one of the inner and outer wall portions has an elongated pin opening. A pair of bail members are each movable among a nest position, an upper stack position, a middle stack position and a lower stack position. Each bail member includes a support portion and arm extending transversely from outer ends of the support portion. A pin extends transversely from an outer end of each arm. Each pin is received in one of the pin openings, with the arm received between the inner and outer wall portions. The pins are slidable and pivotable in the pin openings to move the bail members to the various positions. Because the arms of the bail members are received between the inner and outer wall portions, accidental dislodgement of the bail member pins from the pin openings is prevented.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
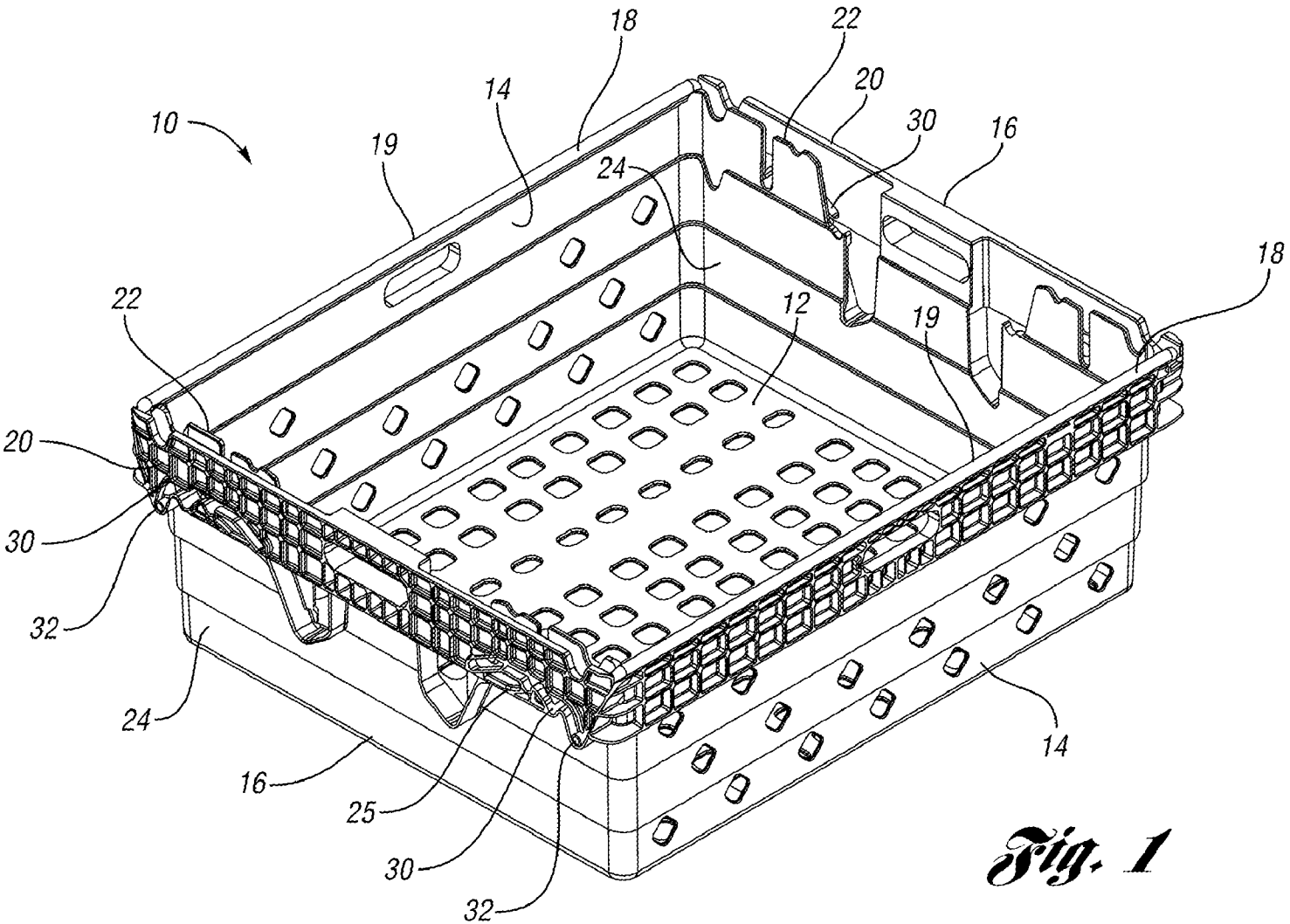
FIG. 1 is a perspective view of a container according to a first embodiment of the present invention with the bail members in the nest position.

A container 10 according to the present invention is shown in FIG. 1. The container 10 includes a floor 12 and a pair of opposed side walls 14 and a pair of opposed end walls 16. A pair of bail members 18 are each mounted to each end wall 16, such that a support portion 19 of each bail member 18 extends across the length of the container 10. The end walls 16 each include an upper wall portion that has an outer wall portion 20 spaced from an inner wall portion 22. A lower wall portion 24 is generally aligned below the inner wall portion 22, such that the outer wall portion 20 forms a ledge 25 along the end wall 16.

Figure 2:
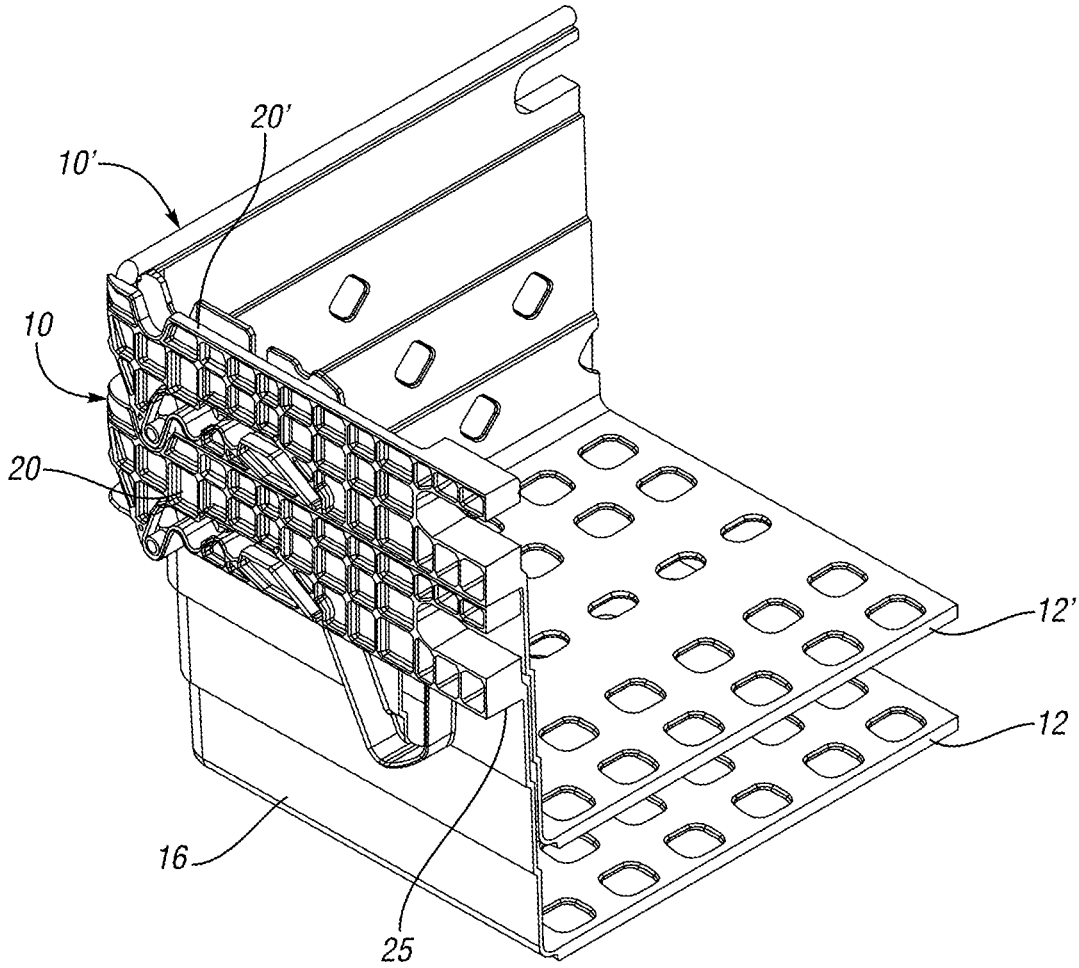
FIG. 2 is a quarter sectioned perspective view of the container of FIG. 1, with a similar container nested therein.

Elongated pin openings 30 are formed in each outer wall portion 20 to trap pins 32 at the outer ends of the bail members 18. The pins 32 are slidable and pivotable within the pin openings 30, such that the bail members 18 can be moved to a plurality of positions and orientations. In FIGS. 1 and 2, the bail members 18 are in the nest position, where the support portions 19 of the bail members 18 are disposed on the side walls 14 and the pins 32 are at first pivot axes in the pin openings 30. In this position, as shown in FIG. 2, a similar container 10' can be nested within the container 10, with the floor 12' nested within the walls 16 of the container 10. The outer wall portion 20' of the above-nested container 10' is supported on the outer wall portion 20 of the container 10.

Figure 3:
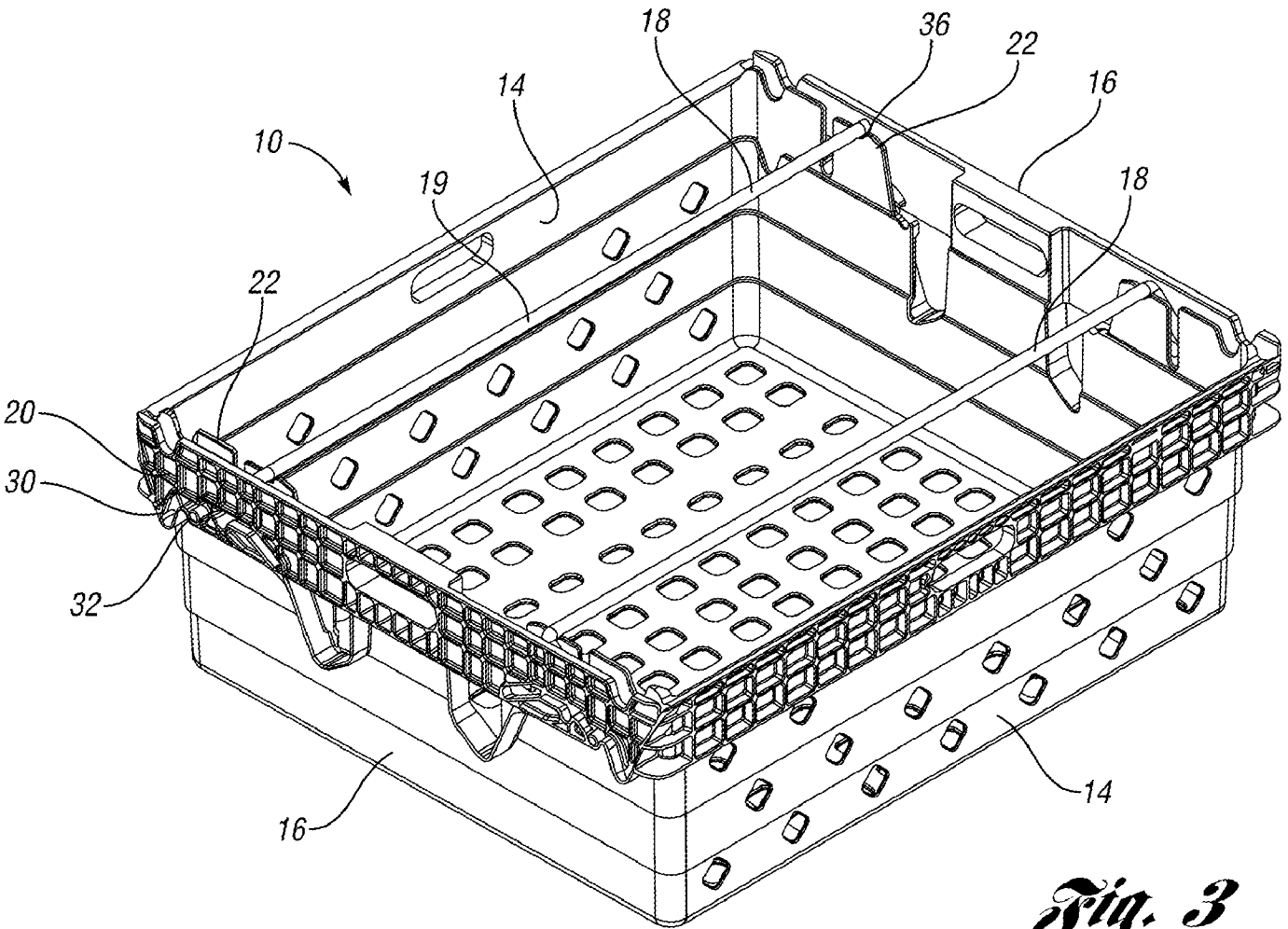
FIG. 3 is a perspective view of the container of FIG. 1 with the bail members in an upper stack position.

FIG. 3 shows the bail members 18 in an upper stack position with each support portion 19 supported on a support rest 36 on the inner wall portion 22, inwardly of the side walls 14 and suspended above the floor 12 by a first height substantially equal to the height of the walls 14, 16. The support rest 36 is a notch formed in the inner wall portion 22 to impede movement of the bail member 18 out of the selected position.

Figure 4:
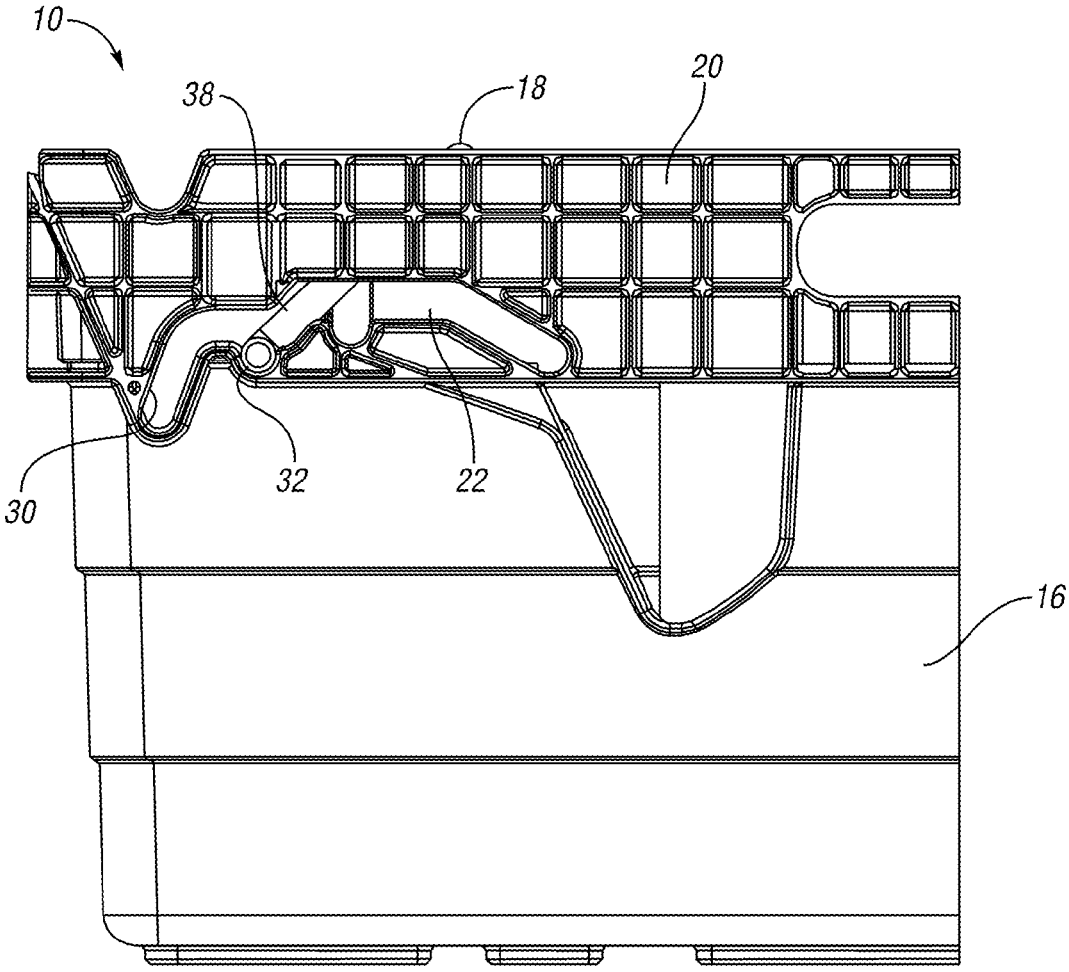
FIG. 4 is an end view of half of the container of FIG. 3.

Referring to FIG. 4, the pin 32 is pivotable in a second pivot axis in the pin opening 30 and the bail member 18 protrudes slightly from the top of the container 10. An arm 38 of the bail member 18 between the support portion 19 and each pin 32 is received between the inner wall portion 22 and outer wall portion 20. The inner and outer wall portions 22, 20 prevent contact with the arm 38 by users or by other containers or objects, which prevents the pin 32 from being knocked out of the pin opening 30.

Figure 5:
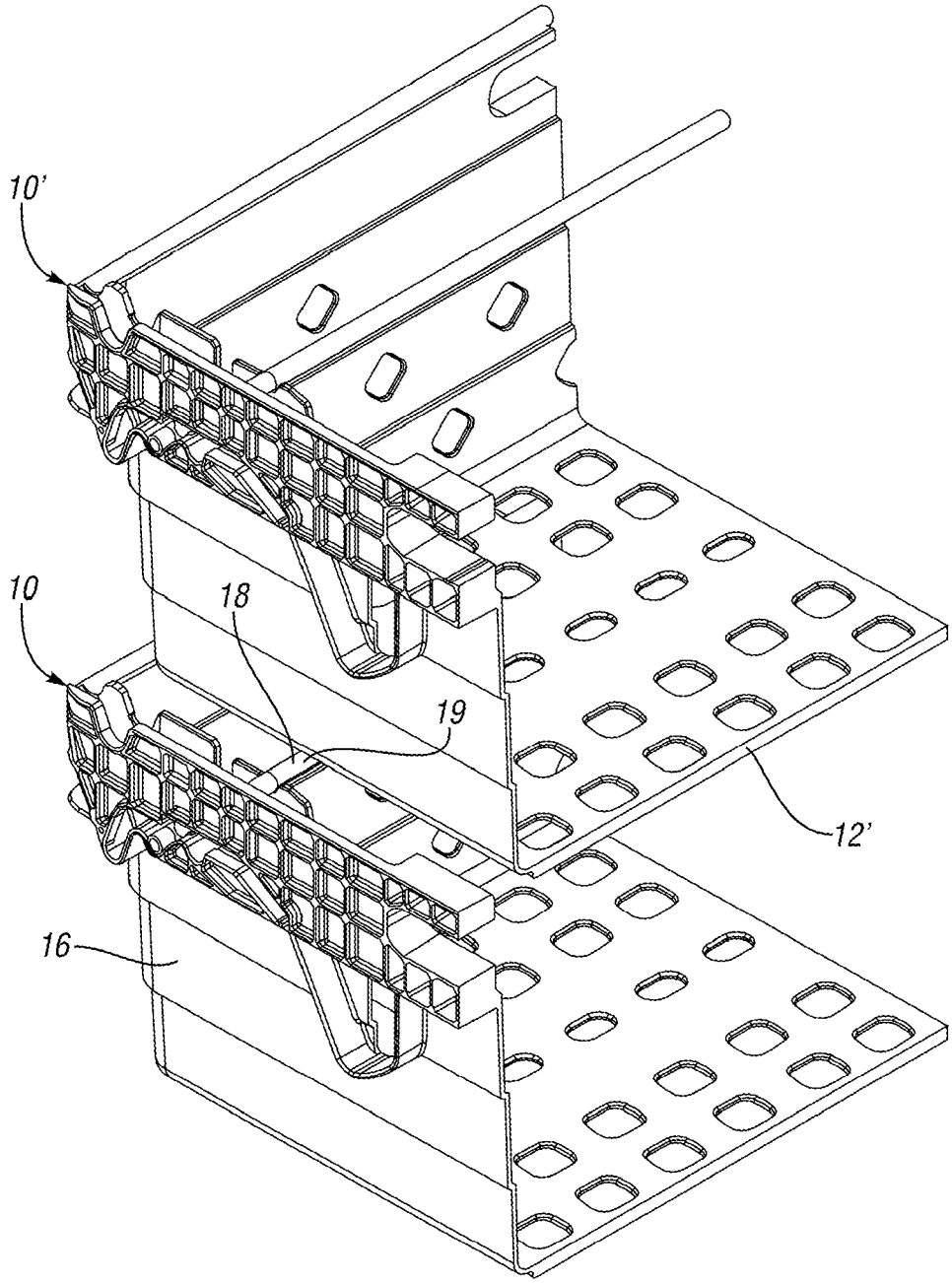
FIG. 5 is a quarter sectioned perspective view of the container of FIG. 3, with a similar container stacked thereon.

FIG. 5 shows the container 10 with the bail member 18 in the upper stack position supporting a similar container 10', such that the floor 12' of the upper container 10' is supported by the support portion 19 of the bail member 18 of the lower container 10. This position provides the maximum storage capacity in the container 10, while keeping the weight of the upper container 10' off the container 10 contents.

Figure 6:
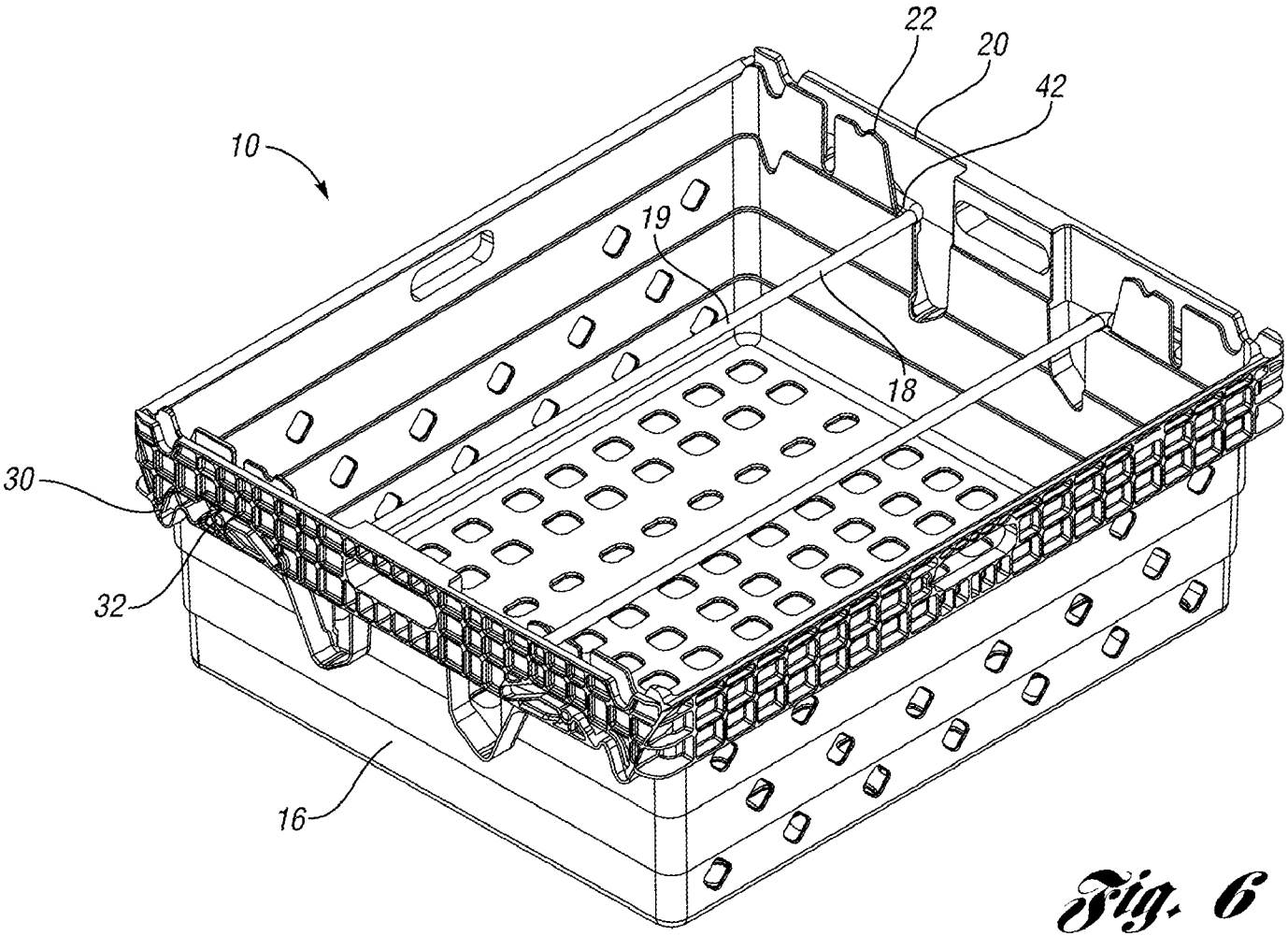
FIG. 6 is a perspective view of the container of FIG. 1 with the bail members in a middle stack position.
Figure 7:
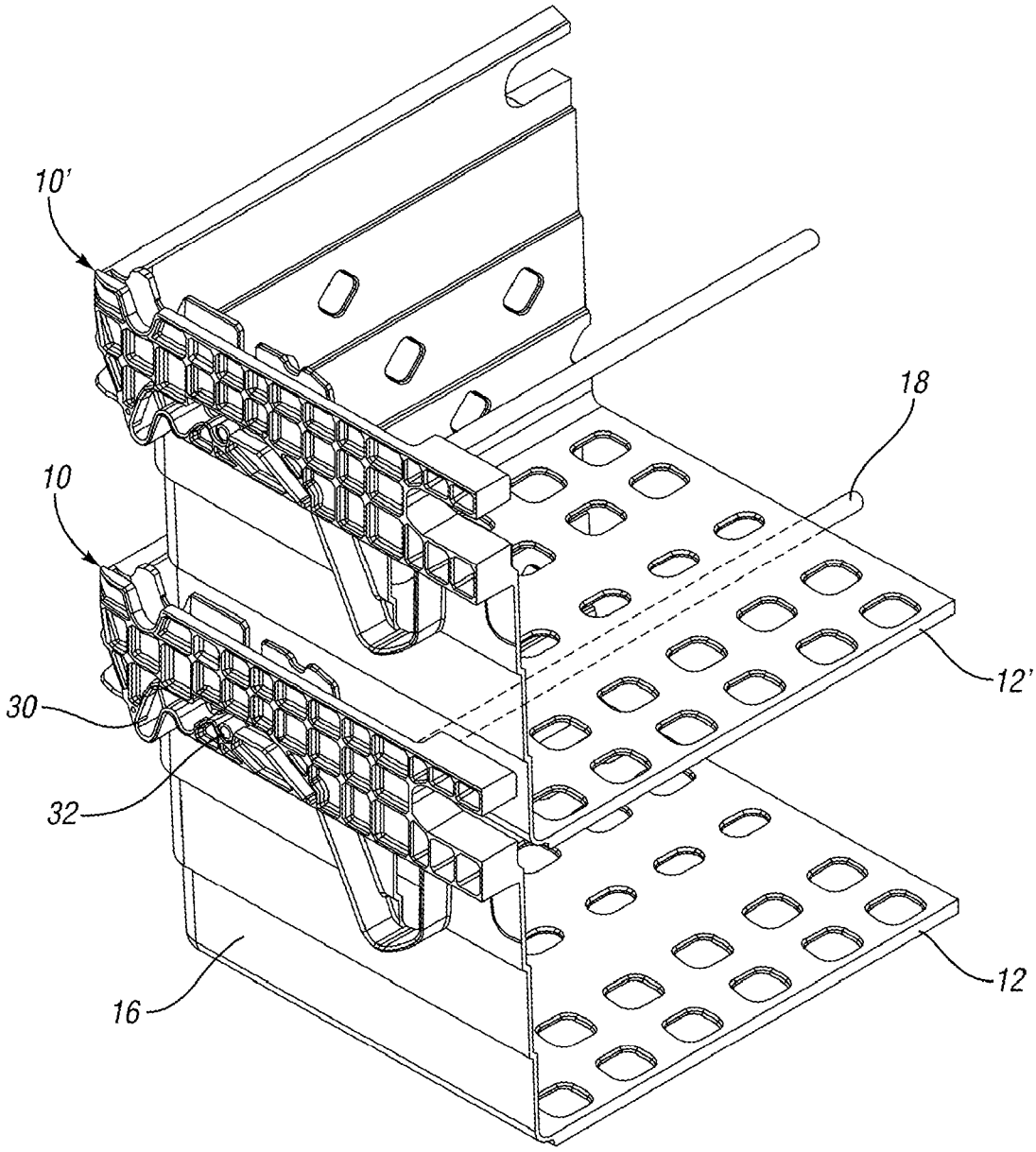
FIG. 7 is a quarter sectioned perspective view of the container of FIG. 6, with a similar container stacked thereon.

FIG. 6 shows the container 10 with the bail members 18 in a middle stack position on support rests 42 on the inner wall portions 22 and with the pins 32 in third pivot axes in the pin openings 30. The support rests 42 are notches formed in the inner wall portion 22 to impede movement of the bail member 18 out of the selected position. As shown in FIG. 7, the upper container 10' is supported at a middle height above the floor 12 by the bail member 18 in the middle position.

Figure 8:
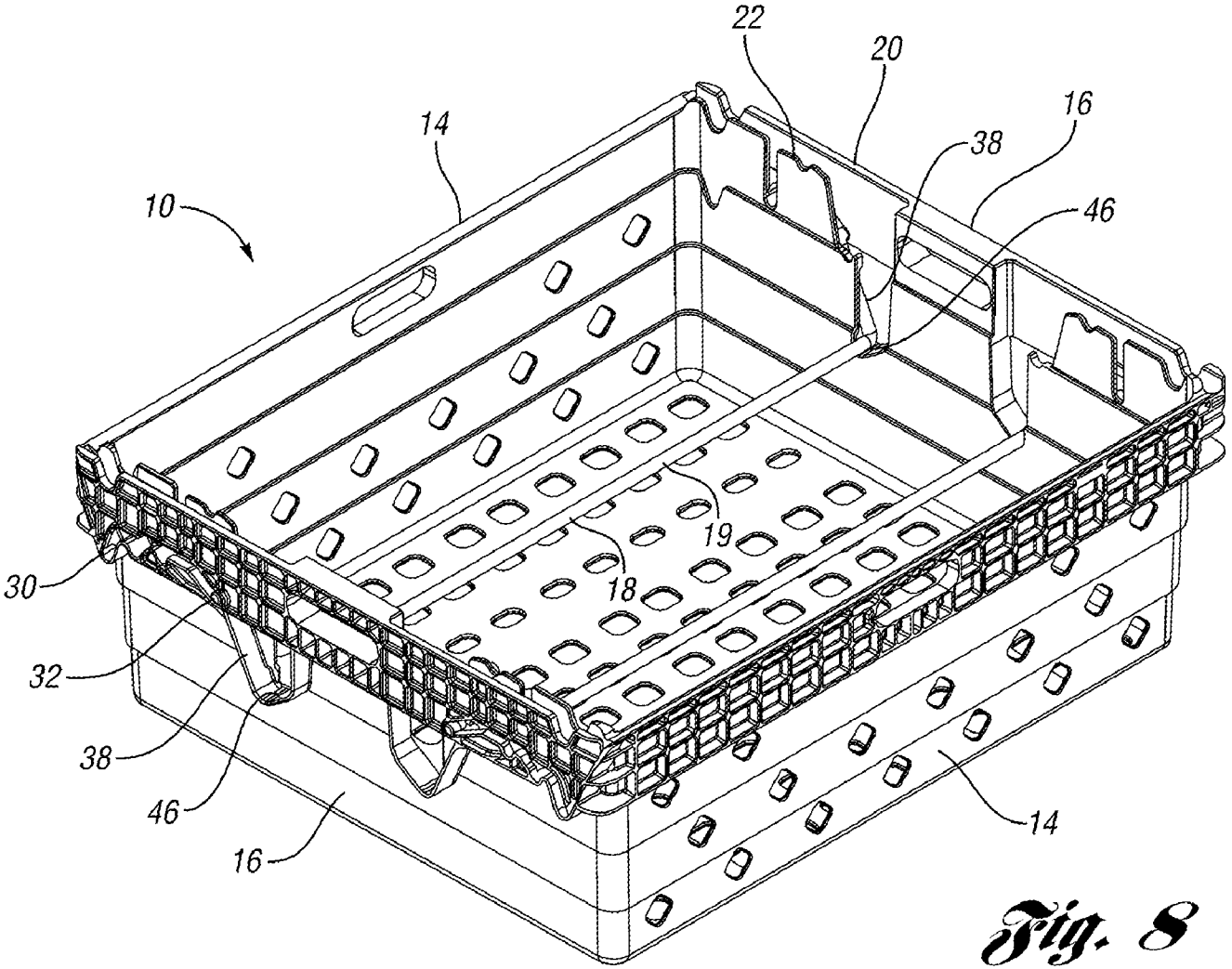
FIG. 8 is a perspective view of the container of FIG. 1 with the bail members in a lower stack position.
Figure 9:
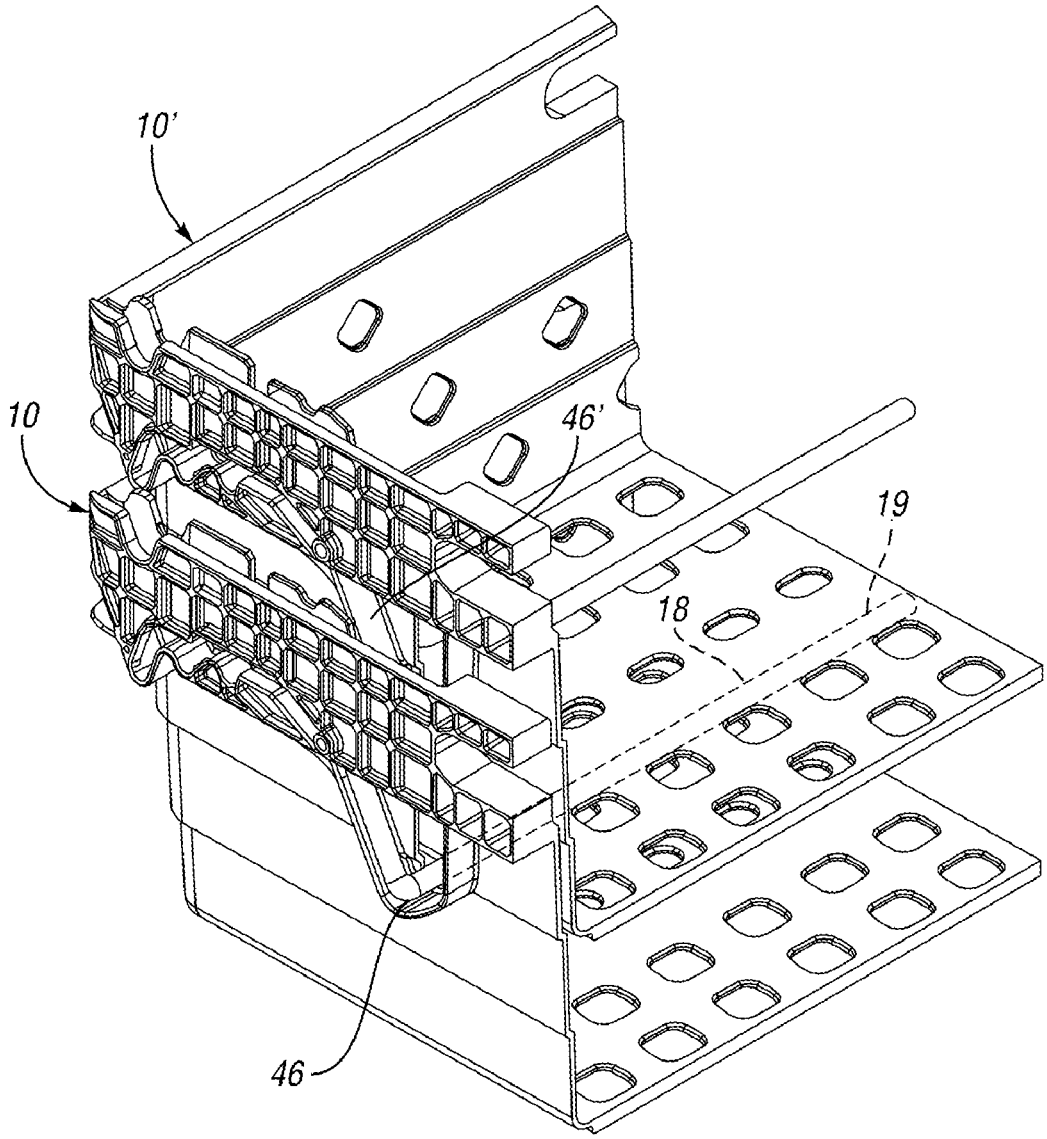
FIG. 9 is a quarter sectioned perspective view of the container of FIG. 8, with a similar container stacked thereon.

FIG. 8 shows the container 10 with the bail members 18 in a lower stack position on support rests 46 on the inner wall portions 22 and with the pins 32 in fourth pivot axes at ends of the pin openings 30. The support rest 46 is a notch formed in the inner wall portion 22 to impede movement of the bail member 18 out of the selected position. As shown in FIG. 9, the upper container 10' is supported at a minimal height above the floor 12 by the bail member 18 in the lower position. The support rests 46' of the upper container 10' nest within the outer wall portions 22 of the container 10.

Figure 10:
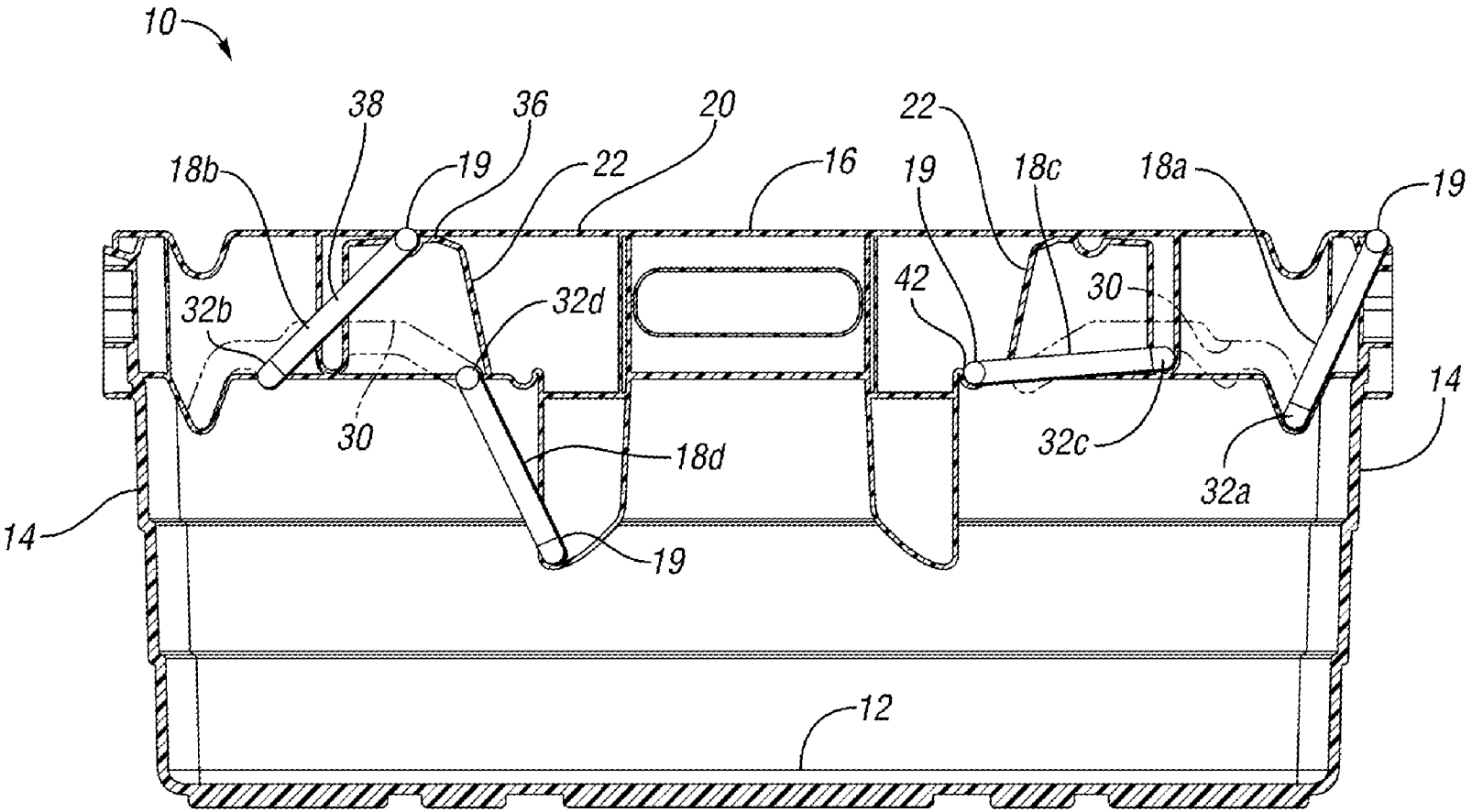
FIG. 10 is a composite interior view of an end wall of the container of FIG. 1, showing the four positions of the bail members.

FIG. 10 is an interior composite view of an end wall 16 of the container 10, showing all four of the positions of the bail members 18 and pins 32, with the reference characters "a" through "d" appended to signify the four positions. The portion of the bail member 18 illustrated in phantom is positioned between the inner wall 22 and the outer wall 20. Bail member 18*a* is in the nest position with the pin 32*a* in the first pivot axis in the pin opening 30. In the nest position, the support portion 19 of the bail member 18 is not inwardly of the side walls 14, and thus permits nesting of a similar container in container 10.

Bail member 18*b* is in the upper stack position with the pin 32*b* in the second pivot axis in the pin opening 30. In the upper stack position, the support portion 19 of the bail member 18 is supported on support rest 36 of the inner wall 22, at a height substantially equal to the height of the walls 14, 16.

Bail member 18*c* is in the middle stack position with the pin 32*c* in the third pivot axis in the pin opening 30. In the middle stack position, the support portion 19 of the bail member 18 is supported on support rest 42 of the inner wall 22, at a middle height from the floor 12.

Bail member 18*d* is in the lower stack position with the pin 32*d* in the fourth pivot axis in the pin opening 30. In the lower stack position, the support portion 19 of the bail member 18 is supported on support rest 46 of the inner wall 22, at a minimal height from the floor 12.

Upward protrusions extend upwardly into the pin opening 30 between each of the pivot axes to inhibit unintended movement of the pin 32 between pivot axes. Further, the arm 38 of the bail member 18 is always between the inner wall portion 22 and the outer wall portion 20. This prevents accidental dislodgement of the pins 32*a-d* from the pin opening 30.

The container 10 provides a nest position and three selectable heights for the support portions 19 of the bail members 18. Depending on how much is stored in the container 10, the bail members 18 can be adjusted to support similar containers 10' stacked thereon without resting on the contents.

Figure 11:
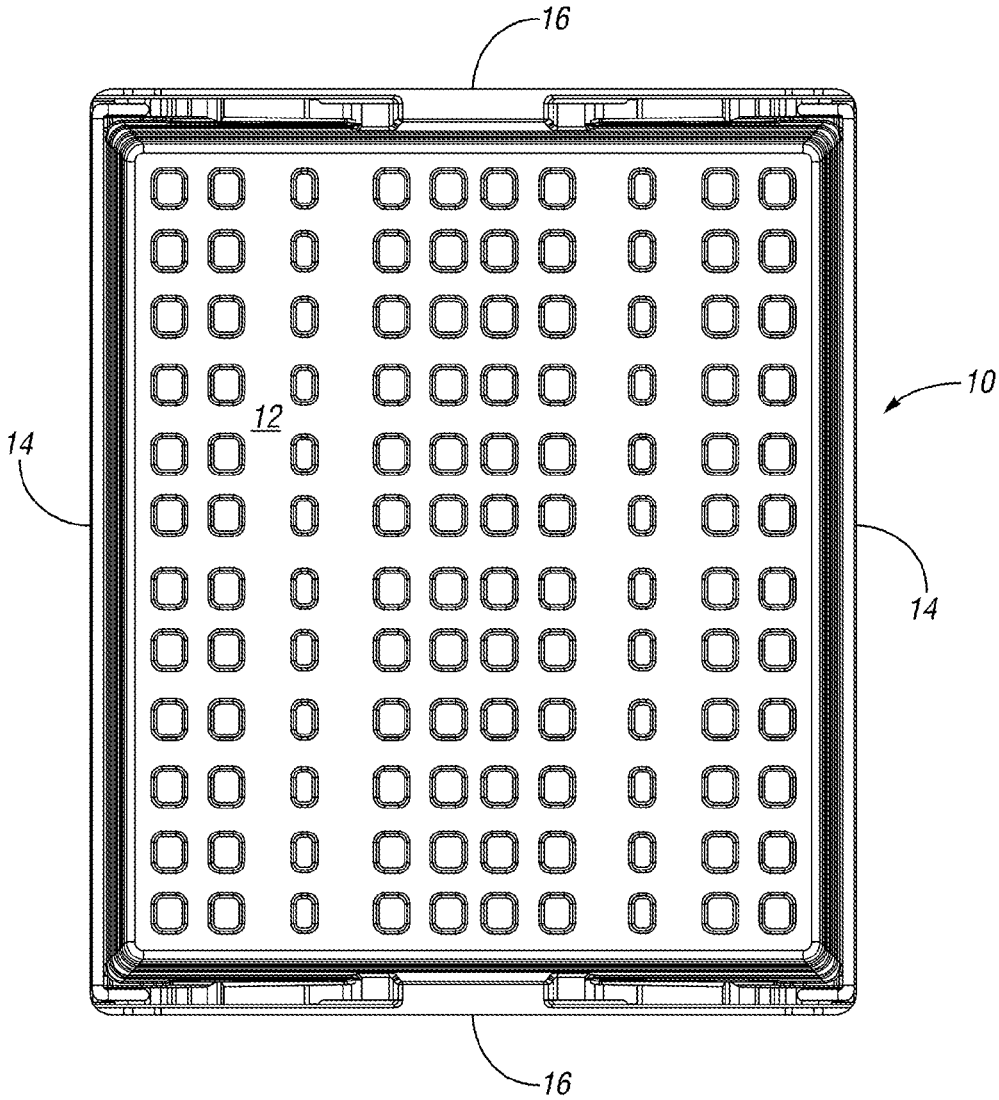
FIG. 11 is a top view of the container of FIG. 1.
Figure 12:
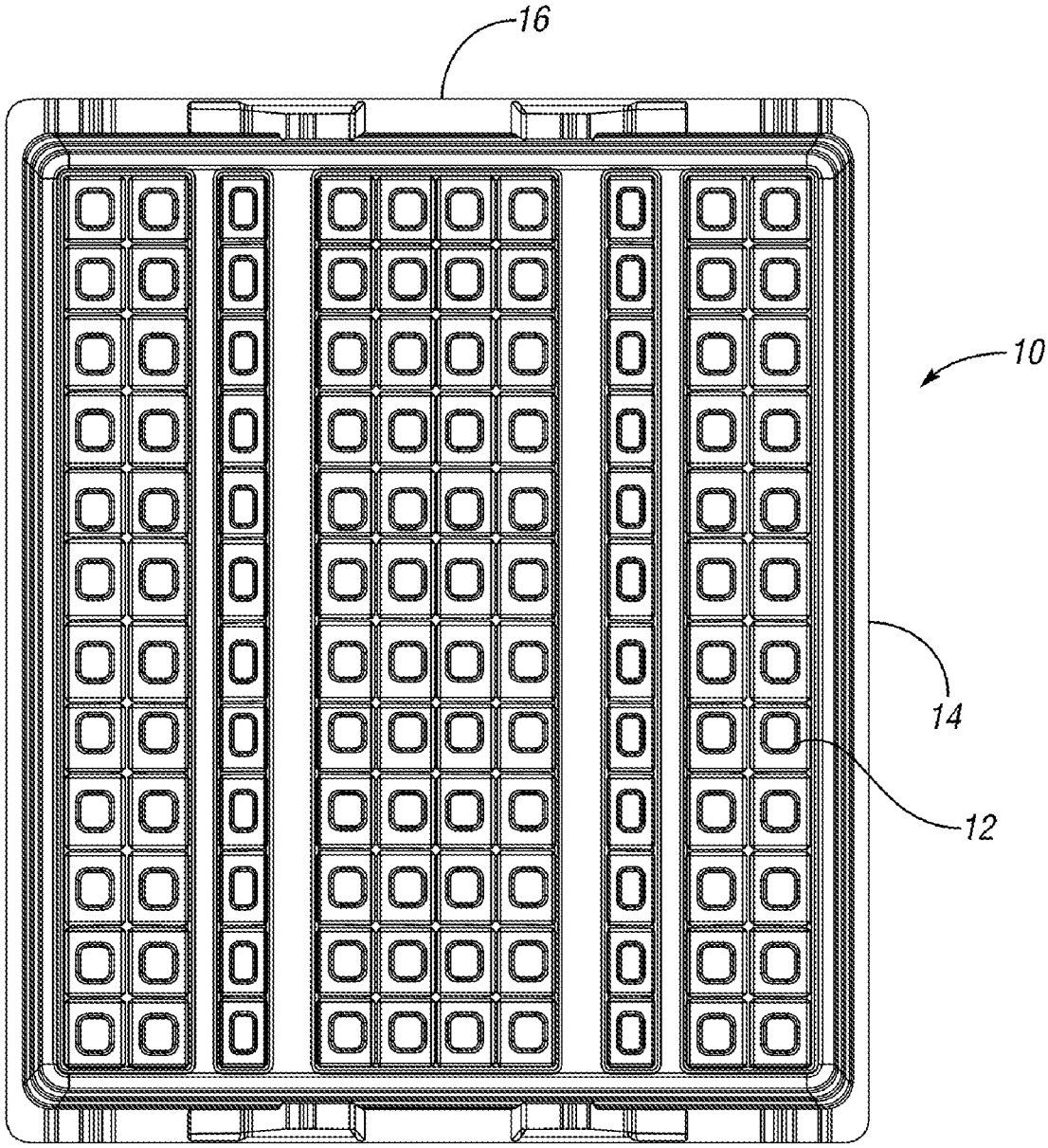
FIG. 12 is a bottom view of the container of FIG. 1.
Figure 13:
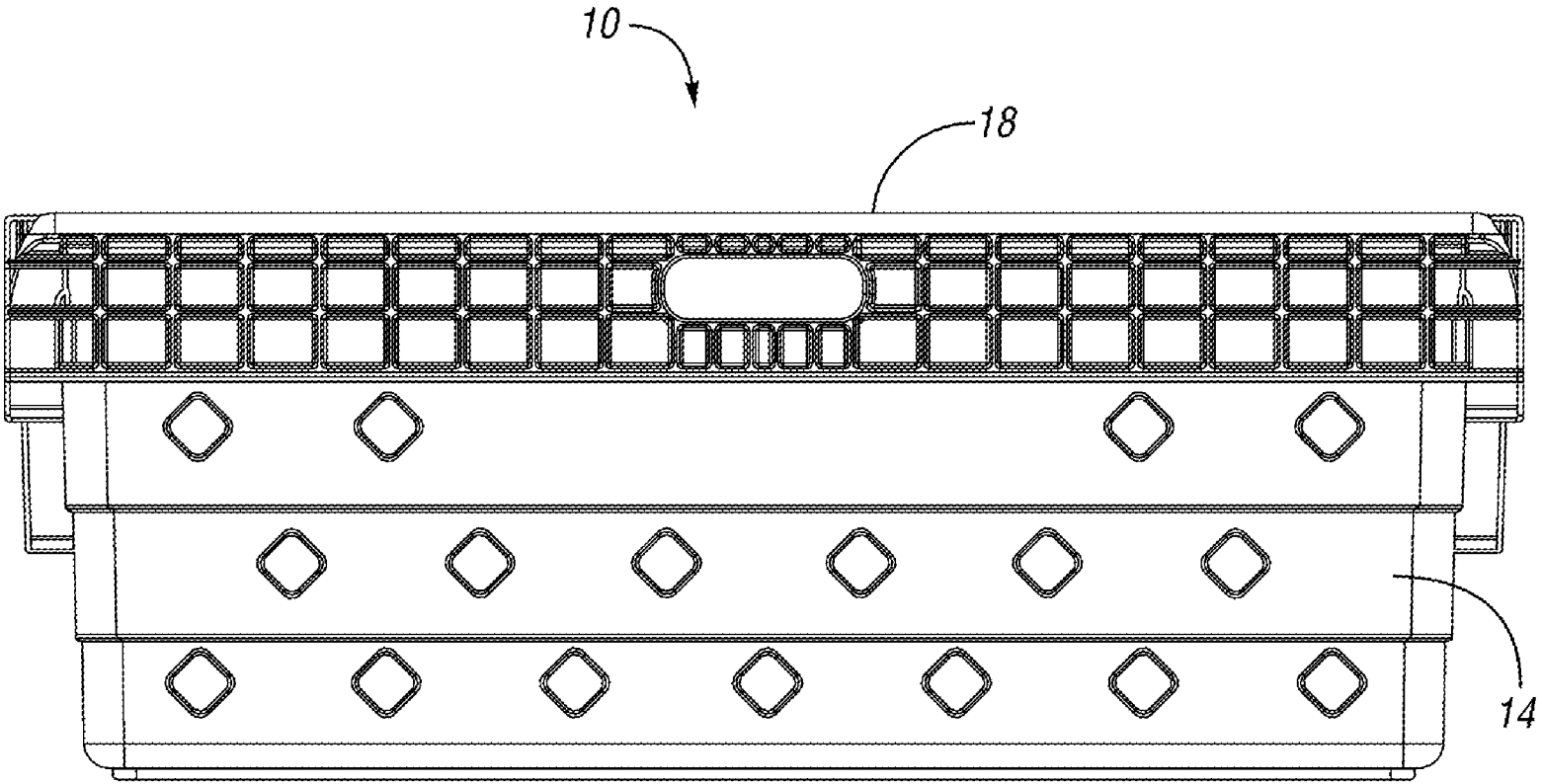
FIG. 13 is a side view of the container of FIG. 1.
Figure 14:
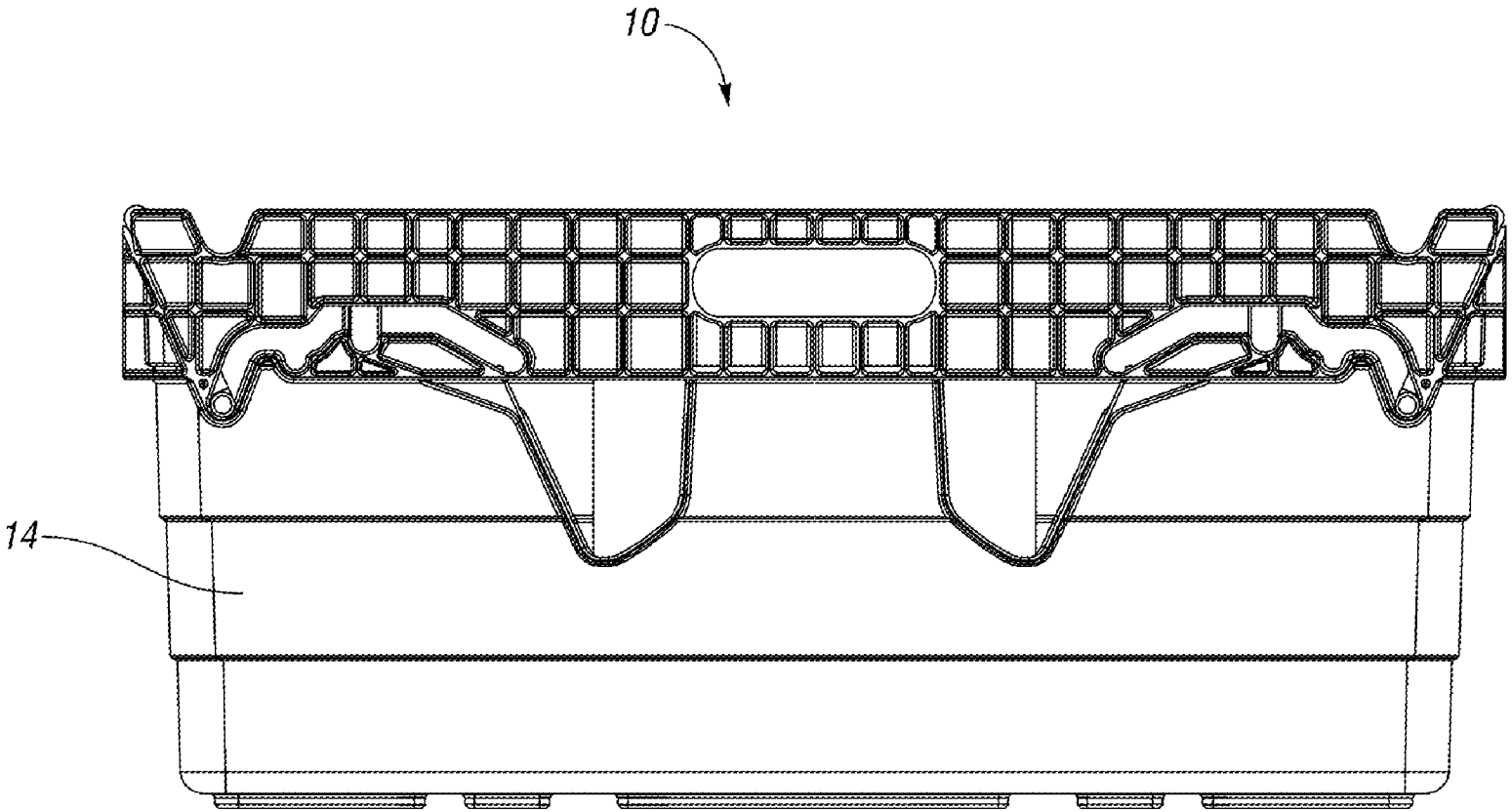
FIG. 14 is an end view of the container of FIG. 1.

FIG. 11 shows a top view of the container 10. FIG. 12 shows a bottom view of the container 10. FIG. 13 is a side view of the container 10. FIG. 14 is an end view of the container 10.

A container 110 according to a second embodiment of the present invention is shown in FIGS. 15-25. Components corresponding to those in the first embodiment are given a similar reference numeral, preappended with the numeral "1." The container 110 includes side walls 114 and end walls 116 extending upwardly from a floor 112. End walls 116 include outer wall portions 120 and inner wall portions 122. Pin openings 130 are formed in the outer wall portions 122 and receive the pins 132 of the bail members 118. An upward protrusion 134 extends into the pin opening 130.

Figure 15:
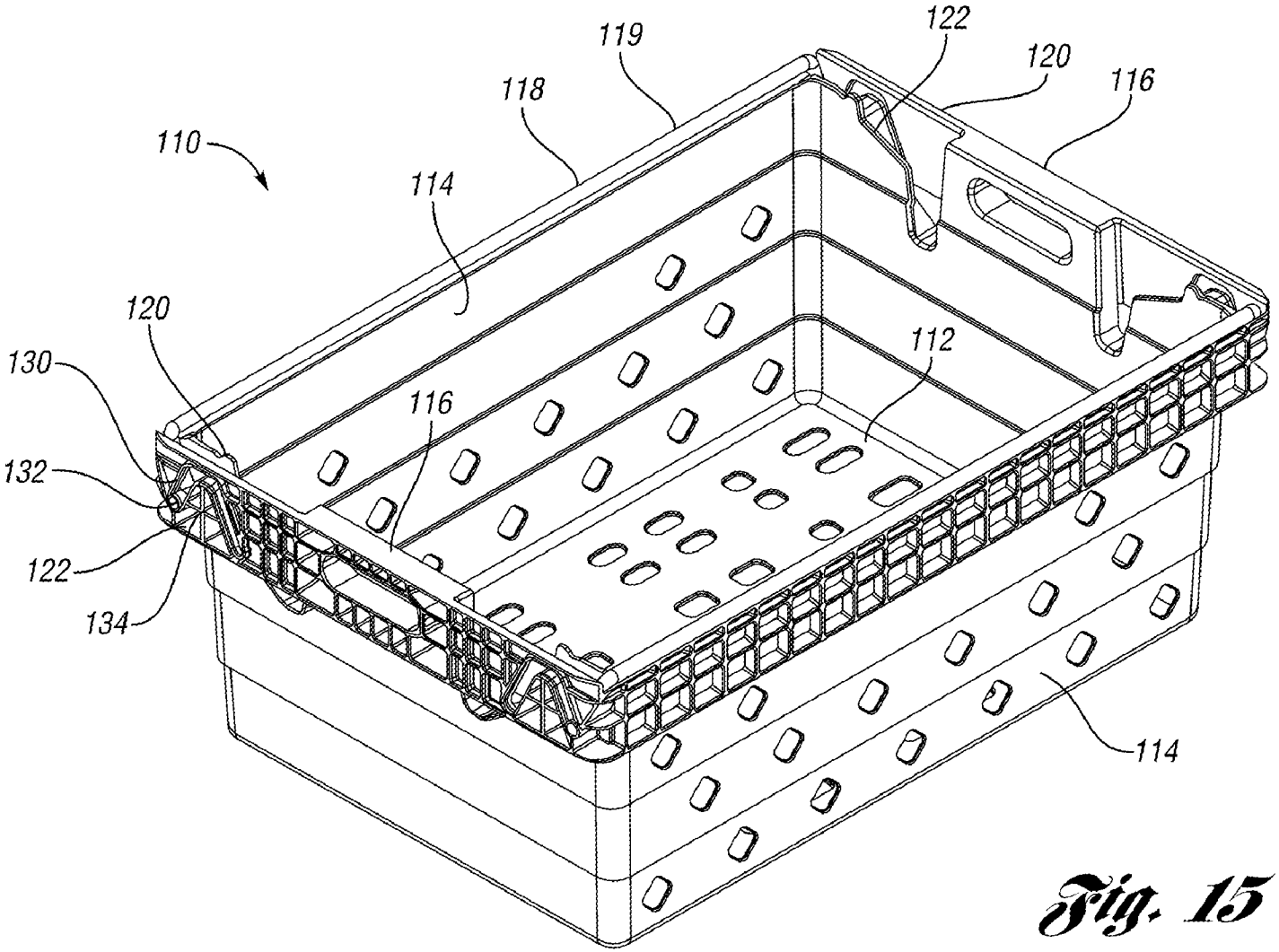
FIG. 15 is a perspective view of a container according to a second embodiment of the present invention with the bail members in the nest position.
Figure 16:
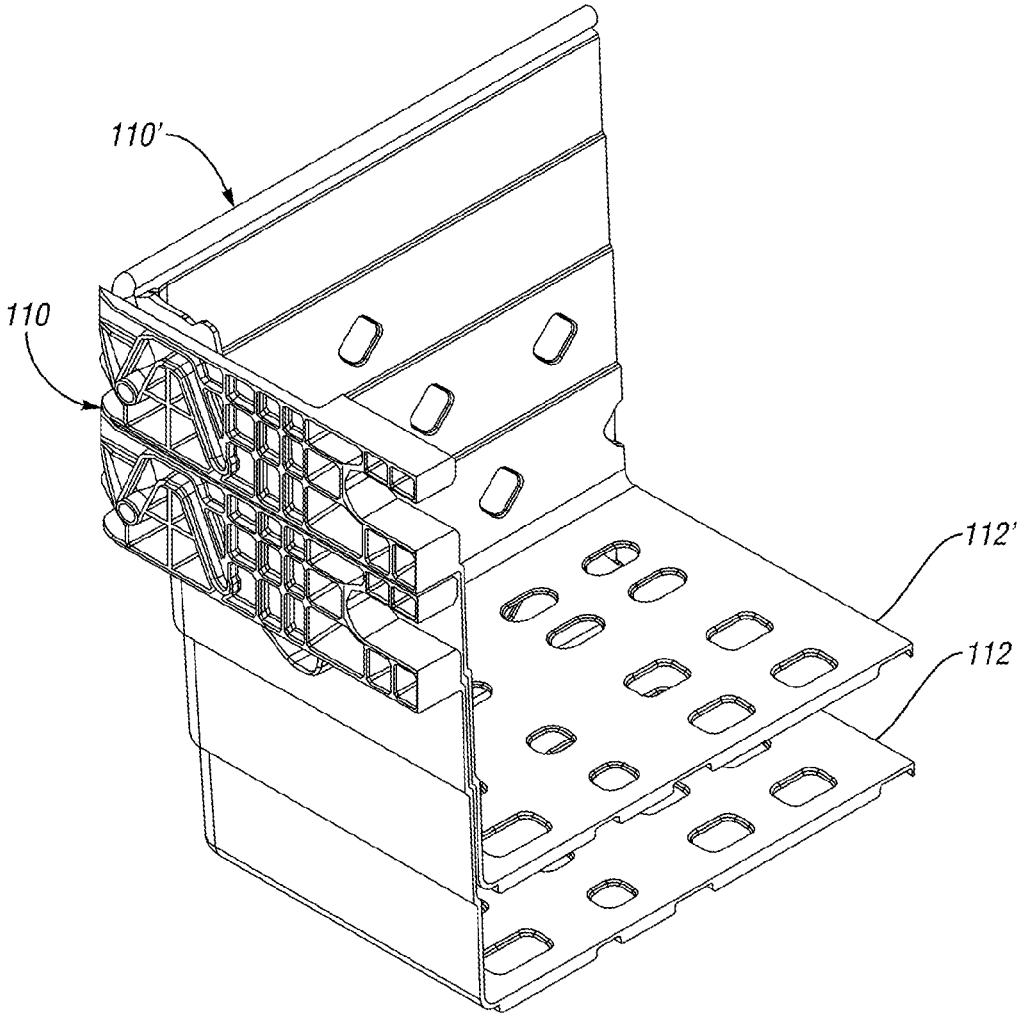
FIG. 16 is a quarter sectioned perspective view of the container of FIG. 15 with a similar container stacked thereon.

In FIGS. 15 and 16, the bail members 118 are shown in the nest position, with the support portions 119 of the bail members 118 on the side walls 114 and with the pins 132 at first pivot axes in the pin openings 130. In this position, a similar container 110' can nest within the container 110 when stacked thereon, as shown in FIG. 16.

Figure 17:
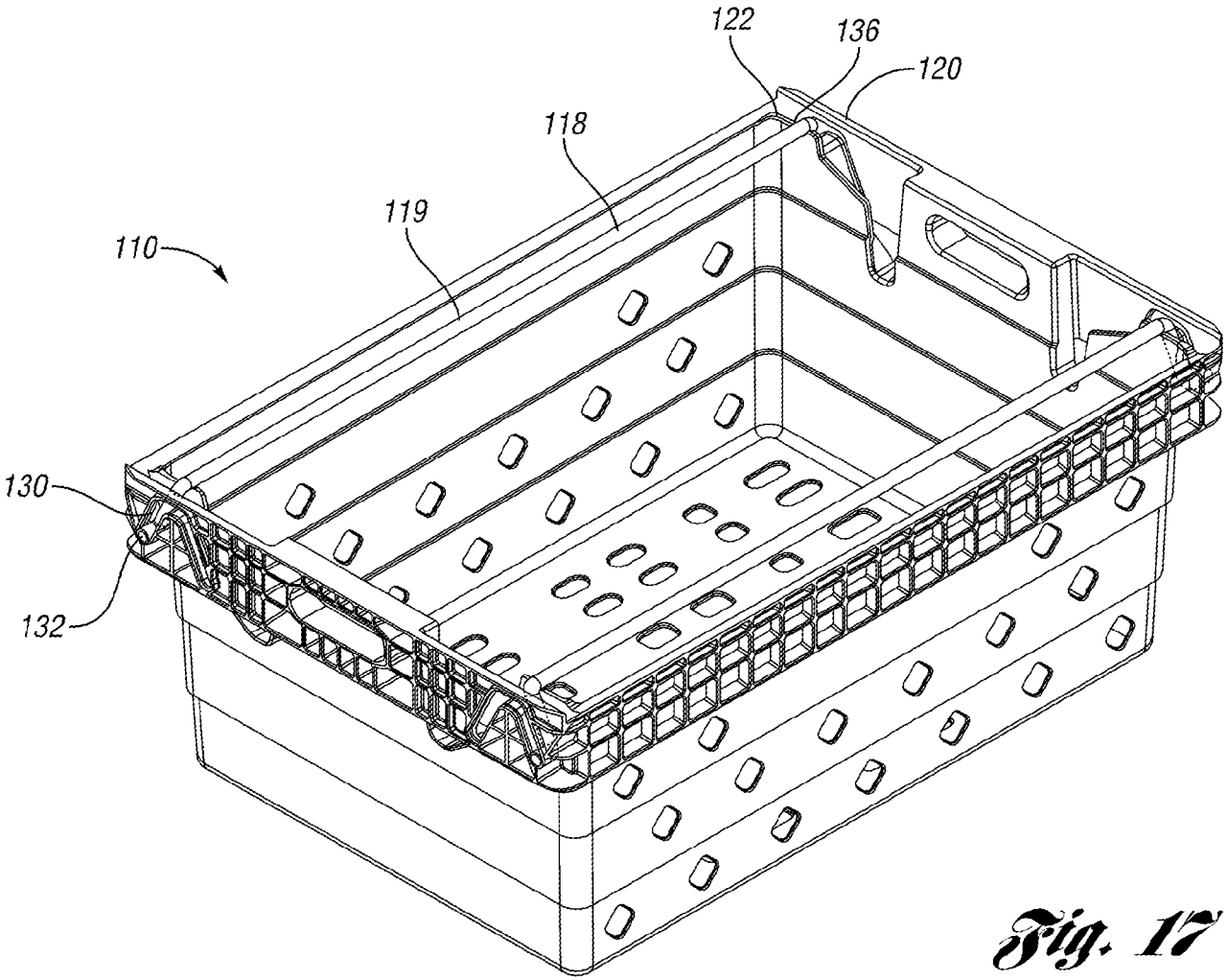
FIG. 17 is a perspective view of the container of FIG. 15 with the bail members in an upper stack position.
Figure 18:
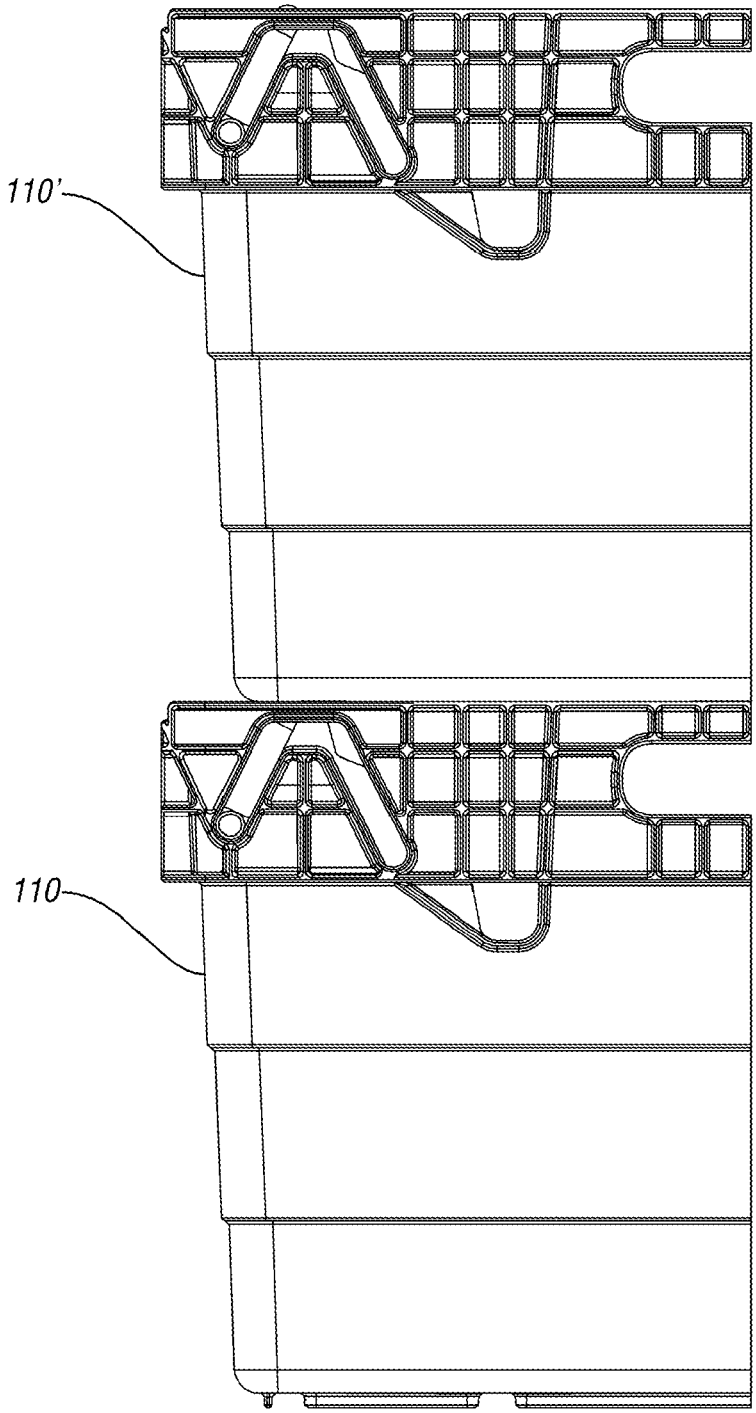
FIG. 18 is an end view of half of the container of FIG. 17 with a similar container stacked thereon.

In FIGS. 17 and 18, the bail members 118 are shown in the upper stack position with the support portions 119 of the bail members 118 supported on support rests 136. In this position, a similar container 110' is supported on the bail members 118 at a maximum height above the floor 112, as shown in FIG. 18. The pins 132 are still at the first pivot axes, as the bail members 118 are pivotable about the first pivot axis between the nest position (FIGS. 15 and 16) and the upper stack position (FIGS. 17 and 18).

Figure 19:
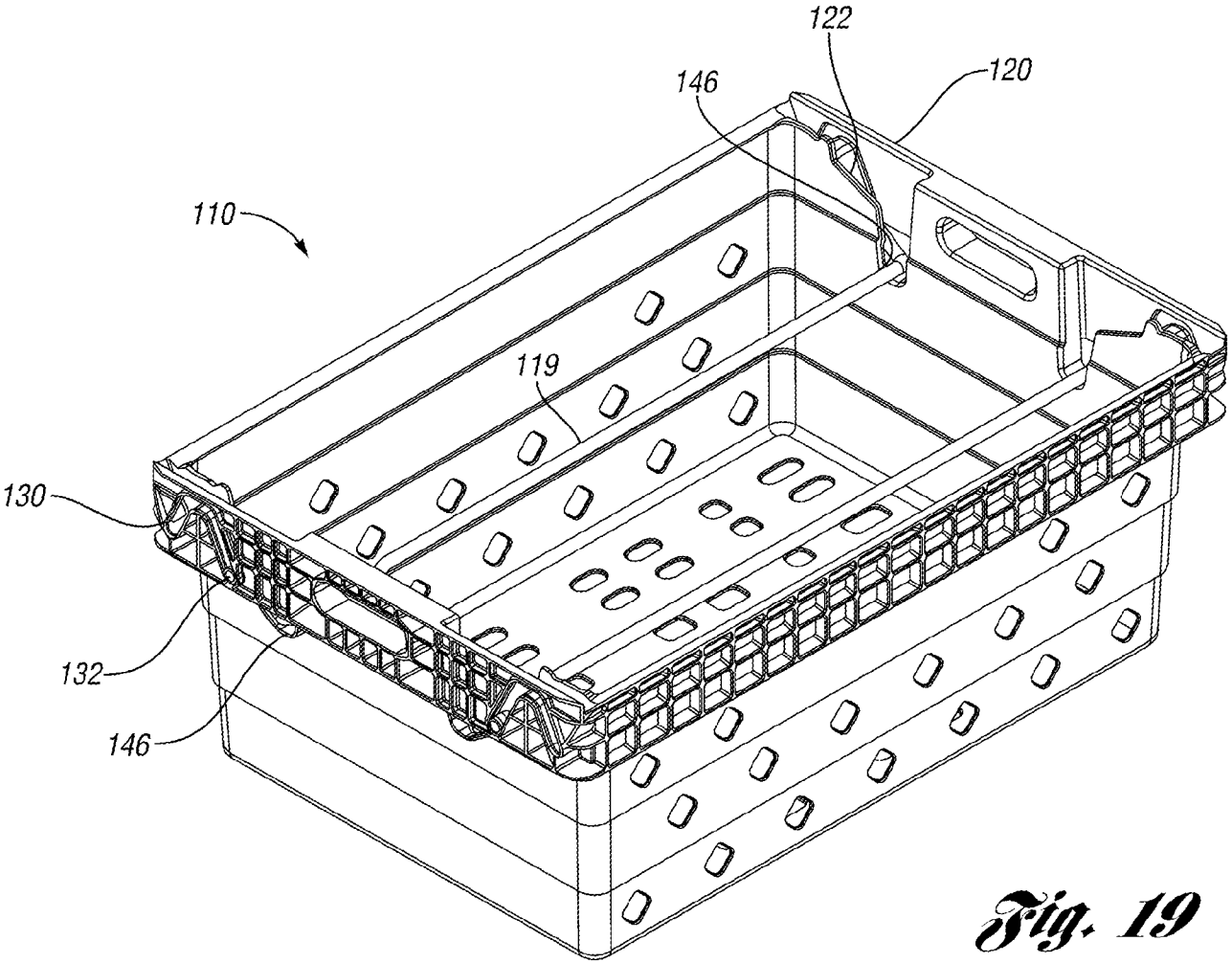
FIG. 19 is a perspective view of the container of FIG. 15 with the bail members in a lower stack position.
Figure 20:
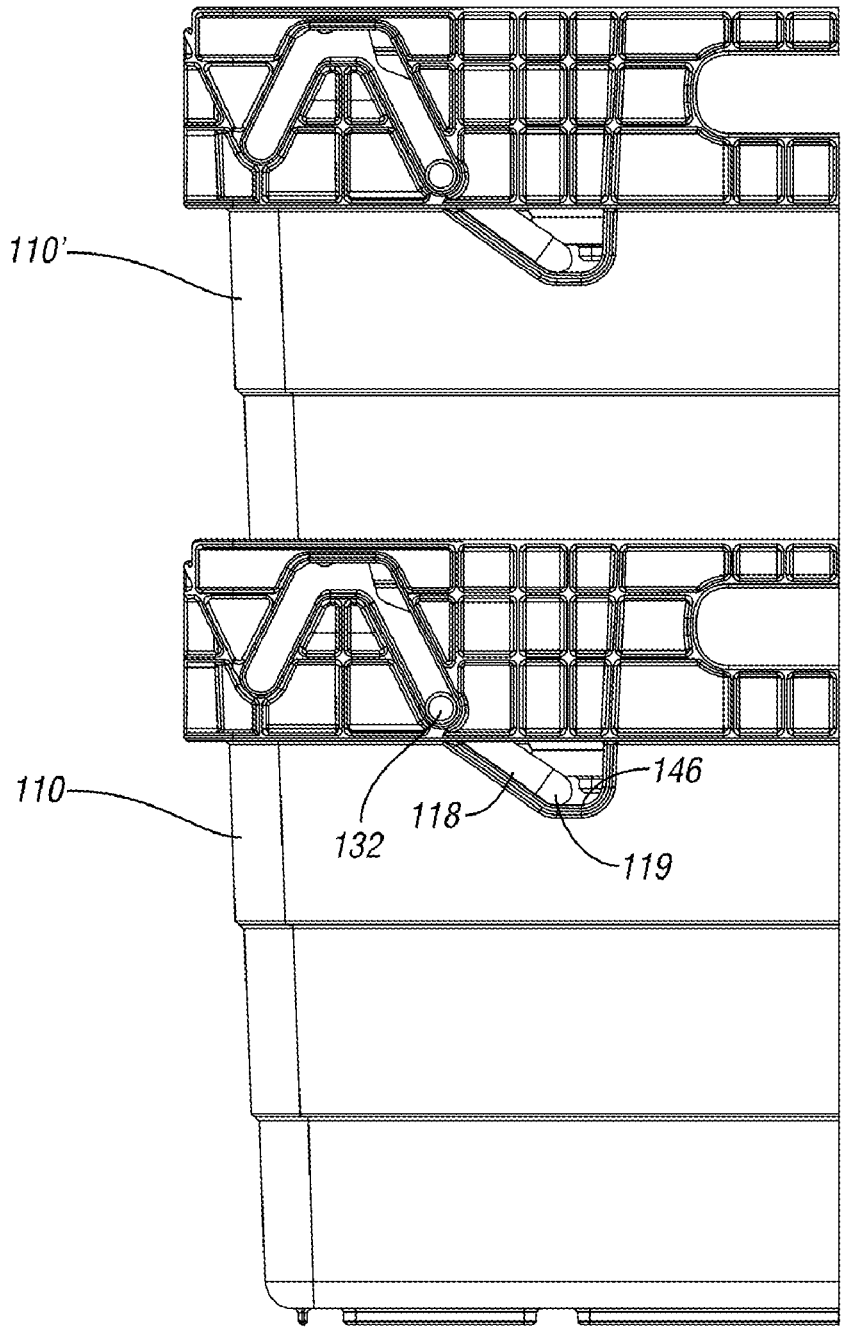
FIG. 20 is an end view of half of the container of FIG. 19, with a similar container stacked thereon.

In FIGS. 19 and 20, the bail members 118 are shown in the lower stack position with the support portions 119 of the bail members 118 supported on the support rests 146. In this position, a similar container 110' is supported on the bail members 118 at a minimum height above the floor 112, as shown in FIG. 20, and the upper container 110' partially nests within the container 110 without putting weight on the contents of the container 110.

Figure 21:
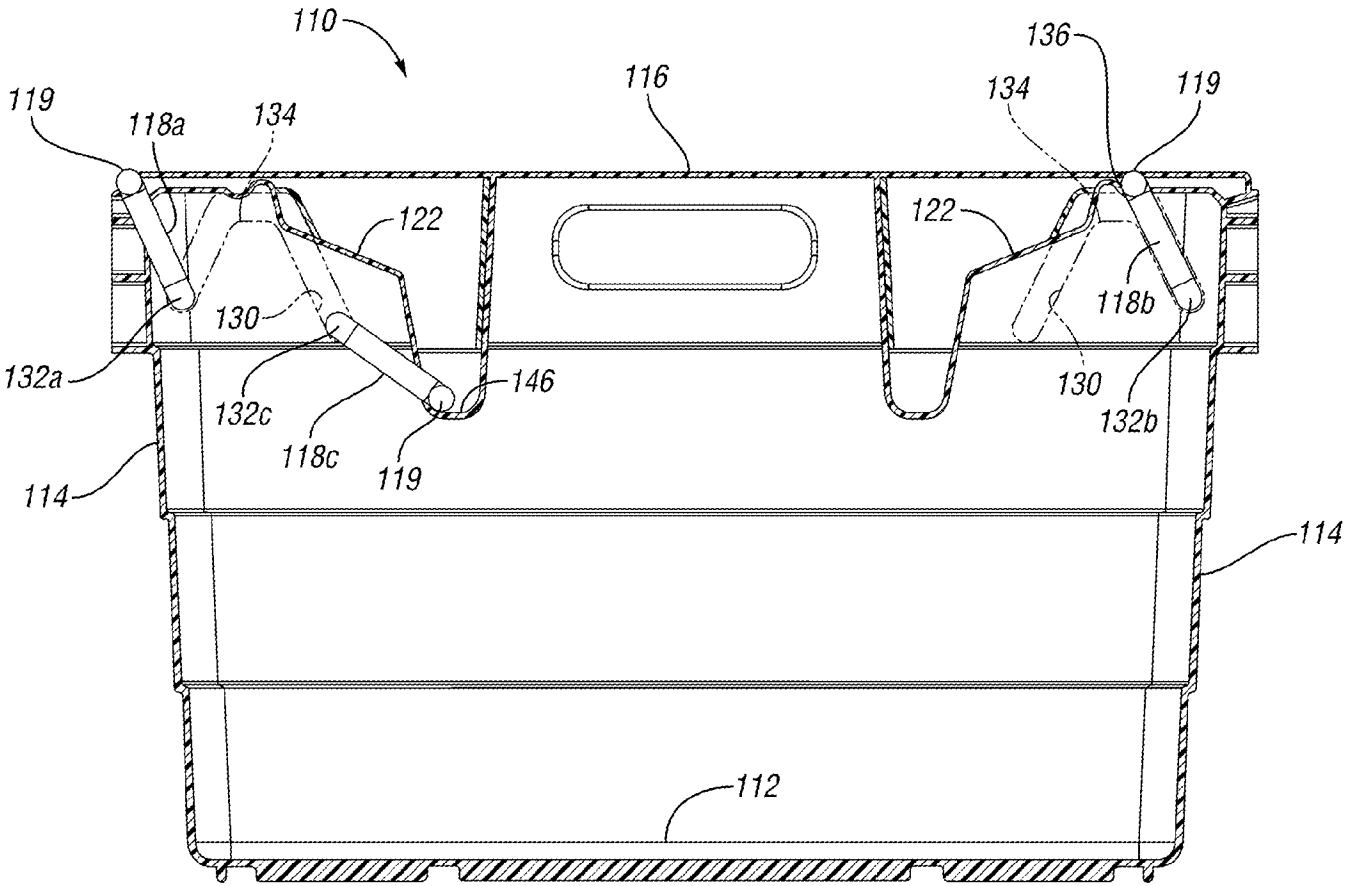
FIG. 21 is a composite interior view of an end wall of the container of FIG. 15, showing the four positions of the bail members.

FIG. 21 is an interior composite view of an end wall 116 of the container 110, showing all three of the positions of the bail members 118 and pins 132, with the reference characters "a" through "c" appended to signify the three positions. Bail member 118*a* is in the nest position with the pin 132*a* in the first pivot axis in the pin opening 130. In the nest position, the support portion 119 of the bail member 118*a* is not inwardly of the side walls 114, and thus permits nesting of a similar container in container 110.

Bail member 118*b* is in the upper stack position with the pin 132*b* in the first pivot axis in the pin opening 130. In the upper stack position, the support portion 119 of the bail member 118*b* is supported on support rest 136 of the inner wall 122, at a height substantially equal to the height of the walls 114, 116.

Bail member 118*c* is in the lower stack position with the pin 132*c* in the second pivot axis in the pin opening 130. In the lower stack position, the support portion 119 of the bail member 118*c* is supported on support rest 146 of the inner wall 122, at a minimal height from the floor 112. The upward protrusion 134 extends upwardly into the pin opening 130 between the pivot axes to inhibit unintended movement of the pin 132 between pivot axes.

Figure 22:
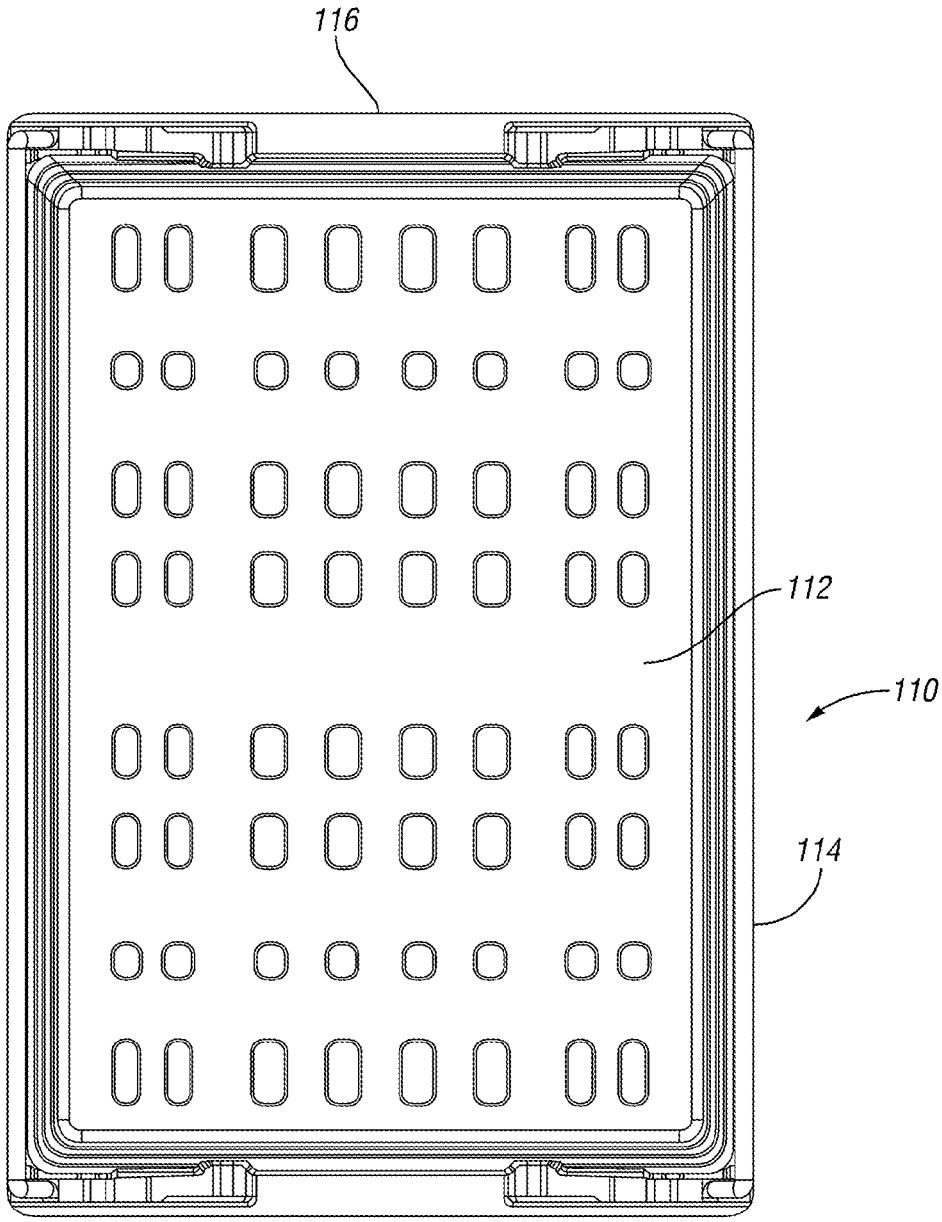
FIG. 22 is a top view of the container of FIG. 15.
Figure 23:
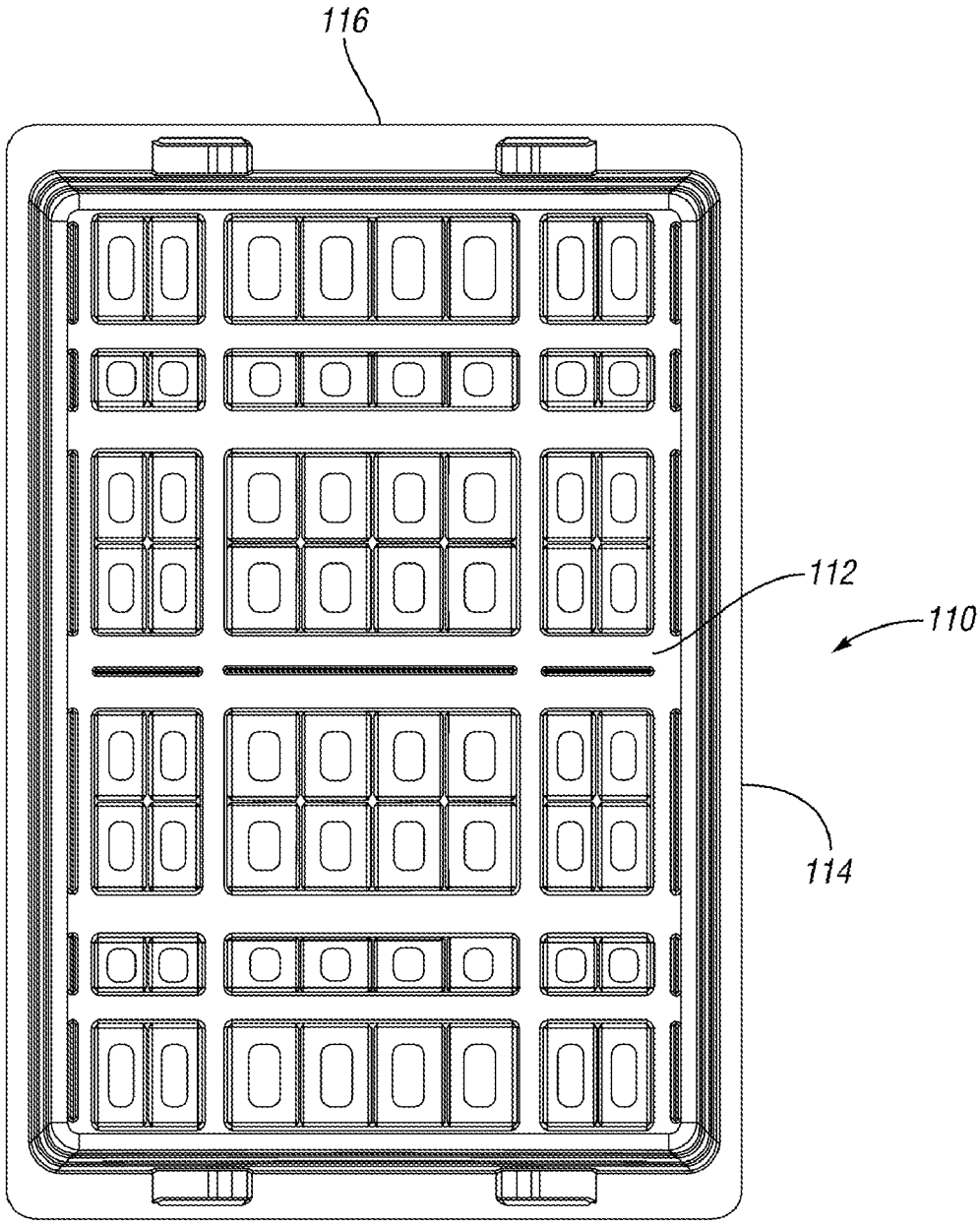
FIG. 23 is a bottom view of the container of FIG. 15.
Figure 24:
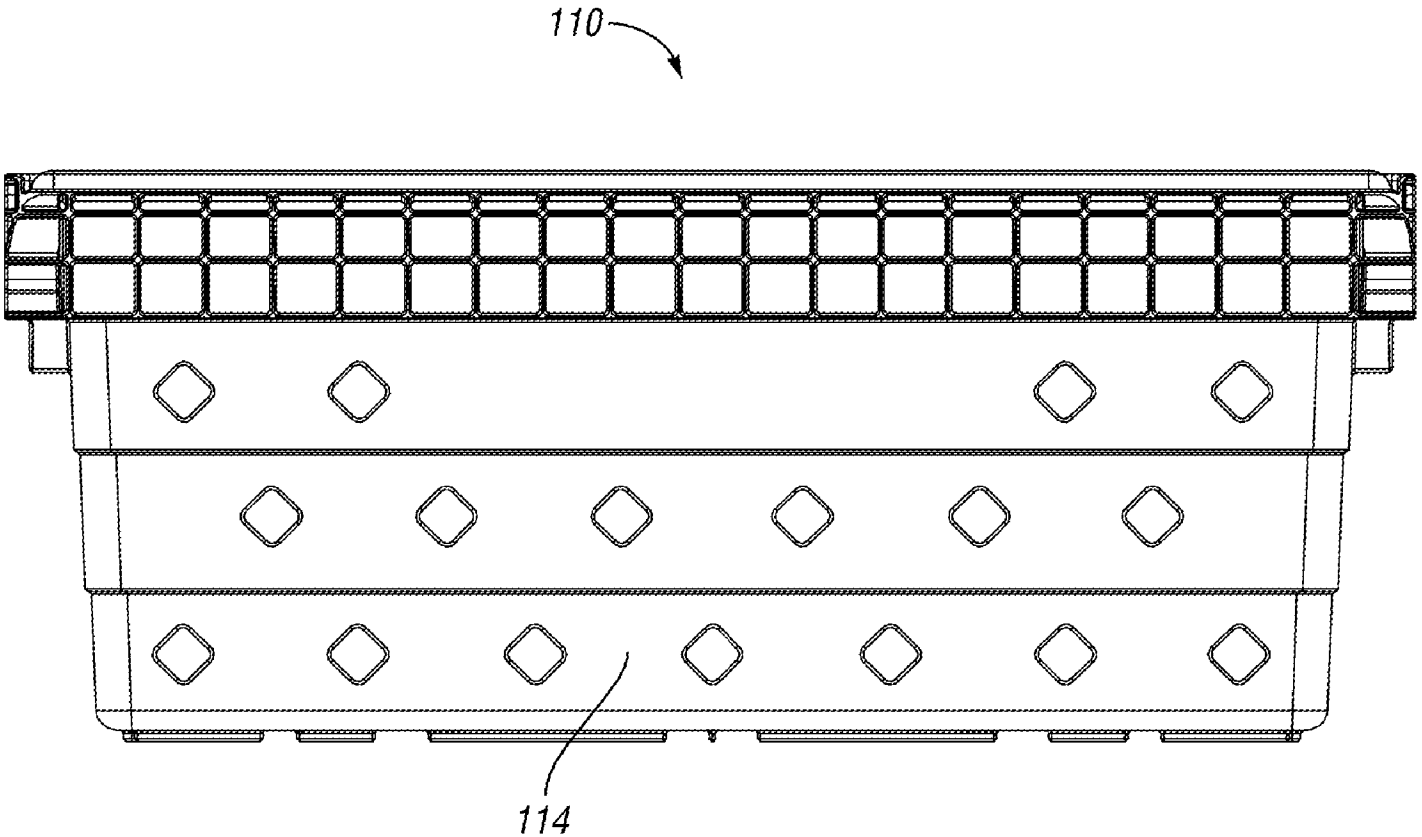
FIG. 24 is a side view of the container of FIG. 15.
Figure 25:
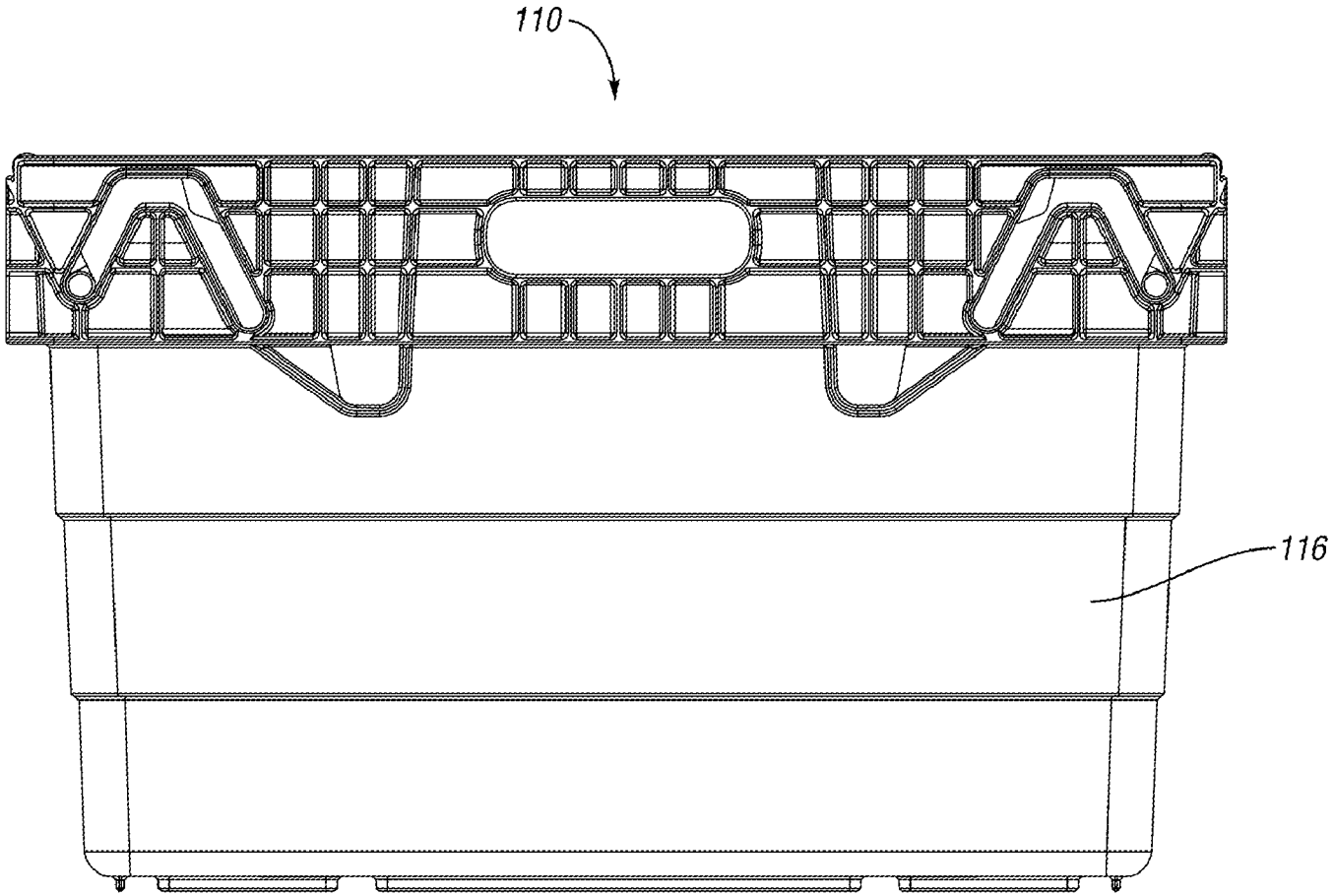
FIG. 25 is an end view of the container of FIG. 15.

FIG. 22 shows a top view of the container 110. FIG. 23 shows a bottom view of the container 110. FIG. 24 is a side view of the container 110. FIG. 25 is an end view of the container 110.

Figure 26:
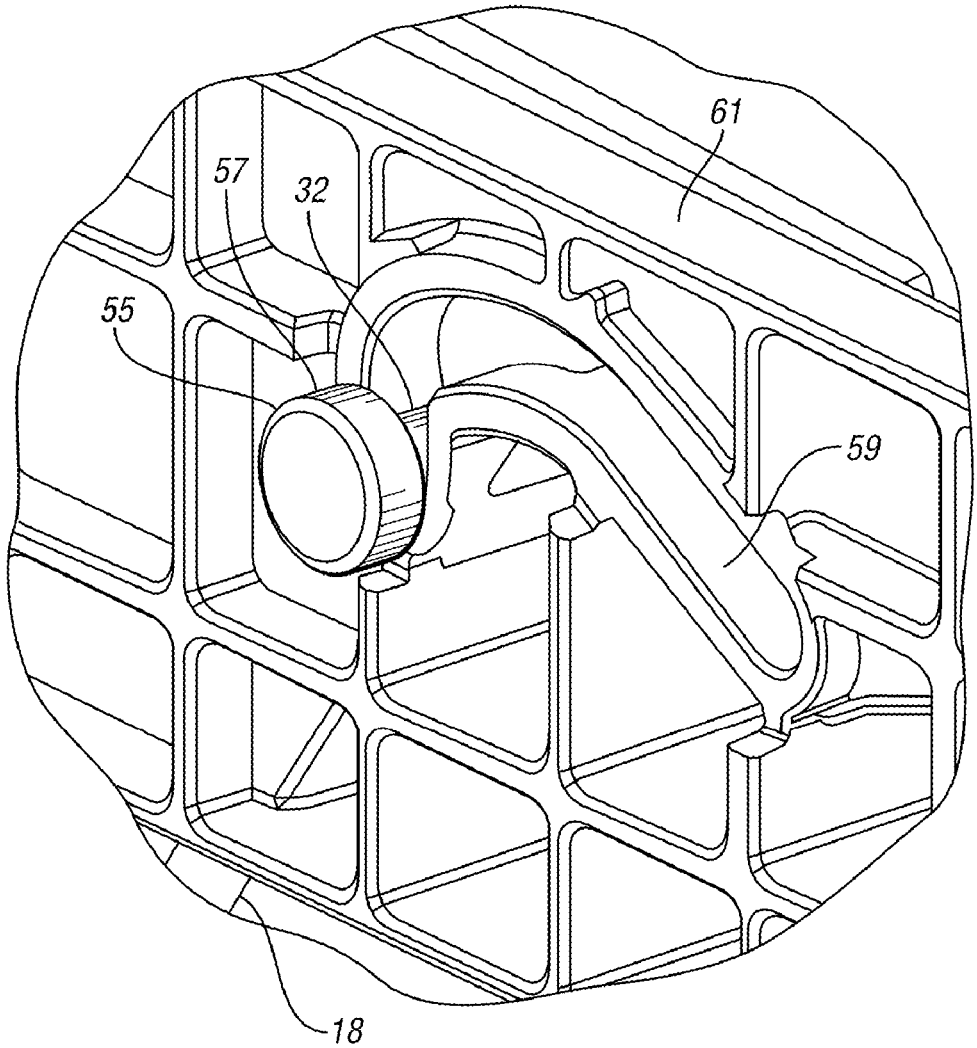
FIG. 26 is an enlarged perspective view of an optional bail cap on a pin of a bail member that could be used in either of the embodiments.

FIG. 26 is an enlarged perspective view showing an optional bail cap 55 which could be used on a pin 32 of a bail member 18 in either of the embodiments. The bail cap 55 has an enlarged portion 57 with a diameter larger than a dimension of an opening 59 in the wall 61. The bail cap 55 is fitted onto the pin 32 after the pin 32 is inserted through the opening 59 in the wall. Because the bail cap 55 has a larger diameter than the dimension of the opening 59, the bail cap 55 prevents the pin 32 from becoming dislodged from the opening 59. The bail cap 55 also helps keep the bail member 18 in alignment, especially when the bail member 18 is moved between positions.

In both embodiments, the walls and floor of the container 10, 110 are integrally molded as a single unitary structure from a plastic material such as polypropylene, but other suitable materials could also be used. The bail members 18, 118 are preferably steel, but could also be glass-filled nylon or other composite material.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are different designs of containers that would benefit from the present invention.

What is claimed is:

1. A container capable of supporting a second container in a plurality of positions relative to the container, the container comprising:

a floor;

an upstanding wall structure including a plurality of walls attached to each other and extending upwardly from the floor to define a unitary construction, one of the walls including an outer wall portion and an inner wall portion spaced inwardly from the outer wall portion, at least one of the inner and outer wall portions having an elongated pin opening; and a bail member having a support portion and an arm extending transversely from the support portion, a pin extending transversely from the arm, the pin received in the pin opening, the arm received between the inner and outer wall portions, the bail member selectively movable among a nest position, a first stack position in which the support portion is a first distance from the floor and a second stack position in which the support portion is a second distance from the floor, the second distance being different from the first distance, wherein the bail member is pivotable about a first pivot axis between the nest position and the first stack position, and wherein the pin of the bail member is at a second pivot axis, spaced from the first pivot axis, when the bail member is in the second stack position.

2. The container of claim 1 wherein the first pivot axis is a third distance from the floor, the third distance less than the first distance and greater than the second distance and wherein the first pivot axis is positioned outward of the second axis.

3. The container of claim 1 wherein the second distance is less than the first distance.

4. The container of claim 1 wherein the arm is one of two arms extending transversely from opposite ends of the support portion, and wherein the pin is one of two pins, each extending from one of the arms.

5. The container of claim 1 wherein the one of the walls includes a lower wall portion and wherein the inner and outer wall portions are an upper wall portion, wherein the inner wall portion is aligned with the lower wall portion and wherein the outer wall portion is positioned outwardly of the lower wall portion.

6. The container of claim 1 wherein the one of the walls includes a second support surface supporting the support portion of the bail member when the bail member is in the second stack position, the second support surface nesting within the walls of a like container when the container is stacked thereon.

7. A container capable of supporting a second container in a plurality of positions relative to the container, the container comprising:

a floor;

an upstanding wall structure including a plurality of walls attached to each other and extending upwardly from the floor to define a unitary construction, one of the walls including an outer wall portion and an inner wall portion spaced inwardly from the outer wall portion, at least one of the inner and outer wall portions having a pin opening, the opening defining a first pivot axis spaced from a second pivot axis by at least one upward protrusion; and a bail member having a support portion and an arm extending transversely from the support portion, a pin extending transversely from the arm, the pin received in the pin opening, the arm received between the inner and outer wall portions, the bail member selectively movable among a nest position, a first stack position in which the support portion is a first distance from the floor and a second stack position in which the support portion is a second distance from the floor, the second distance being different from the first distance, wherein the bail member is pivotable about the first pivot axis when in the nest position, and wherein the bail member is pivotable about the second pivot axis when the bail member is in the second stack position.

8. The container of claim 7 wherein the at least one upward protrusion includes a first ramped surface adjacent the first pivot axis and a second ramped surface adjacent the second pivot axis.

9. The container of claim 8 wherein the first ramped surface extends at an acute angle relative to the floor.

10. The container of claim 9 wherein the bail member is pivotable about the first axis between the nest position and the first stack position.

11. The container of claim 7 wherein the second distance is less than the first distance.

12. The container of claim 7 wherein the arm is one of two arms extending transversely from opposite ends of the support portion, and wherein the pin is one of two pins, each extending from one of the arms.

13. The container of claim 7 wherein the one of the walls includes a lower wall portion and wherein the inner and outer wall portions are an upper wall portion, wherein the inner wall portion is aligned with the lower wall portion and wherein the outer wall portion is positioned outwardly of the lower wall portion.

14. A container capable of supporting a second container in a plurality of positions relative to the container, the container comprising:

a floor;

an upstanding wall structure including a plurality of walls attached to each other and extending upwardly from the floor to define a unitary construction, one of the walls including an outer wall portion and an inner wall portion spaced inwardly from the outer wall portion, at least one of the inner and outer wall portions having a pin opening, the opening defining a first pivot axis at a first end of the opening and a second pivot axis at an opposite, second end of the opening; and a bail member having a support portion and an arm extending transversely from the support portion, a pin extending transversely from the arm, the pin received in the pin opening, the arm received between the inner and outer wall portions, the bail member selectively movable among a nest position, a first stack position in which the support portion is a first distance from the floor and a second stack position in which the support portion is a second distance from the floor, the second distance being different from the first distance, wherein the bail member is pivotable about the first pivot axis when in the first stack position, and wherein the bail member is pivotable about the second pivot axis when the bail member is in the second stack position.

15. The container of claim 14 wherein further including at least one upward protrusion between the first and second pivot axes, and wherein the at least one upward protrusion includes a ramped surface adjacent the first pivot axis.

16. The container of claim 15 wherein the ramped surface extends at an acute angle relative to the floor.

17. The container of claim 16 wherein the bail member is pivotable about the first axis between the nest position and the first stack position.

18. The container of claim 15 wherein the second distance is less than the first distance.

19. The container of claim 15 wherein the arm is one of two arms extending transversely from opposite ends of the support portion, and wherein the pin is one of two pins, each extending from one of the arms.

20. The container of claim 15 wherein the one of the walls includes a lower wall portion and wherein the inner and outer wall portions are an upper wall portion, wherein the inner wall portion is aligned with the lower wall portion and wherein the outer wall portion is positioned outwardly of the lower wall portion.

21. A container capable of supporting a second container in a plurality of positions relative to the container, the container comprising:

a floor;

an upstanding wall structure including a plurality of walls attached to each other and extending upwardly from the floor to define a unitary construction, one of the walls including an outer wall portion and an inner wall portion spaced inwardly from the outer wall portion, at least one of the inner and outer wall portions having a pin opening defining a plurality of pivot axes, the other of the inner and outer wall portions defining a plurality of support rests at different heights from the floor; and a bail member having a support portion and an arm extending transversely from the support portion, a pin extending transversely from the arm, the pin received in the pin opening, the arm received between the inner and outer wall portions, the bail member selectively movable among a nest position, a first stack position in which the support portion is a first distance from the floor, a second stack position in which the support portion is a second distance from the floor, and a third stack position in which the support portion is a third distance from the floor, the first, second and third distances all being different from one another.

22. The container of claim 21 wherein the plurality of pivot axes includes a first pivot axis and a second pivot axis and wherein the bail member is pivotable about the first pivot axis when in the first stack position, and wherein the bail member is pivotable about the second pivot axis when the bail member is in the second stack position.

23. The container of claim 21 wherein the one of the walls includes a second support surface supporting the support portion of the bail member when the bail member is in the second stack position, the second support surface nesting within the walls of a like container when the container is stacked thereon.

24. A container capable of supporting a second container in a plurality of positions relative thereto, the container comprising:

a floor having an upper surface;

a wall structure having a plurality of walls extending upwardly from the floor to form a unitary construction, one of the walls including a pair of wall portions spaced apart from each other, at least one of the pair of wall portions having an elongated pin opening; and a bail member having a support portion and at least one arm extending transversely from the support portion, a pin extending transversely from the at least one arm, the pin received in the pin opening, the at least one arm received between the pair of wall portions, the bail member selectively movable among a nest position, a first stack position in which the support portion is a first distance above the floor upper surface and a second stack position in which the support portion is a second distance above the floor upper surface, the second distance being different from the first distance, wherein the bail member is pivotable about a first pivot axis between the nest position and the first stack position, and wherein the pin of the bail member is at a second pivot axis, spaced from the first pivot axis, when the bail member is in the second stack position.

25. The container of claim 24 wherein the first pivot axis is a third distance above the floor upper surface, the third distance less than the first distance and greater than the second distance and wherein the first pivot axis is positioned outward of the second axis.

26. The container of claim 24 wherein the second distance is less than the first distance.

27. The container of claim 24 wherein the at least one arm is a pair of arms.

28. The container of claim 24 wherein one of the walls includes a lower wall portion and wherein the pair of wall portions are an upper wall portion, wherein one of the pair of wall portions is aligned with the lower wall portion and wherein the other of the pair of wall portions is positioned outwardly of the lower wall portion.

29. A container capable of supporting a second container in a plurality of positions relative thereto, the container comprising:

a floor having an upper surface;

an upstanding wall structure including a plurality of walls extending upwardly from the floor to form a unitary construction, one of the walls including a pair of spaced apart wall portions, at least one of the pair of wall portions having a pin opening, the opening defining a first pivot axis at a first end of the opening and a second pivot axis at an opposite, second end of the opening; and a bail member having a support portion and at least one arm extending transversely from the support portion, at least one pin extending transversely from the at least one arm, the at least one pin received in the pin opening, the at least one arm received between the pair of wall portions, the bail member selectively movable among a nest position, a first stack position in which the support portion is a first distance from the floor upper surface and a second stack position in which the support portion is a second distance from the floor upper surface, the first distance being different from the second distance, wherein the bail member is pivotable about the first pivot axis when in the first stack position, and wherein the bail member is pivotable about the second pivot axis when the bail member is in the second stack position.

30. The container of claim 29 wherein further including at least one upward protrusion between the first and second pivot axes, and wherein the at least one upward protrusion includes a ramped surface adjacent one of the first and second pivot axes.

31. The container of claim 29 wherein the bail member is pivotable about the first pivot axis between the nest position and the first stack position.

32. The container of claim 29 wherein the one of the walls includes a lower wall portion and wherein the pair of wall portions define an upper wall portion, wherein one of the pair of wall portions is aligned with the lower wall portion and wherein the other of the pair of wall portions is positioned outwardly of the lower wall portion.

* * * * *